US008651824B2

(12) United States Patent
Ward

(10) Patent No.: US 8,651,824 B2
(45) Date of Patent: Feb. 18, 2014

(54) CONDENSATE PUMP

(75) Inventor: Charles Barry Ward, Alpharetta, GA (US)

(73) Assignee: Diversitech Corporation, Duluth, GA (US)

( * ) Notice: Subject to any disclaimer, the term of this patent is extended or adjusted under 35 U.S.C. 154(b) by 914 days.

(21) Appl. No.: 12/636,825

(22) Filed: Dec. 14, 2009

(65) Prior Publication Data

US 2011/0061415 A1 Mar. 17, 2011

Related U.S. Application Data

(63) Continuation-in-part of application No. 12/244,152, filed on Oct. 2, 2008, which is a continuation-in-part of application No. 11/277,445, filed on Mar. 24, 2006, now abandoned, application No. 12/636,825, which is a continuation-in-part of application No. 12/190,212, filed on Aug. 12, 2008, now abandoned.

(60) Provisional application No. 60/976,962, filed on Oct. 2, 2007, provisional application No. 60/665,533, filed on Mar. 25, 2005, provisional application No. 60/956,741, filed on Aug. 20, 2007.

(51) Int. Cl.
*F04B 49/00* (2006.01)

(52) U.S. Cl.
USPC ..... 417/36

(58) Field of Classification Search
USPC ..... 417/18, 36, 41, 53, 423.3, 12; 137/392–395; 73/290 V, 304 C; 62/280, 62/291, 150, 285; 222/64–66, 638, 639, 222/642, 644, 650
See application file for complete search history.

(56) References Cited

U.S. PATENT DOCUMENTS

| | | | |
|---|---|---|---|
| 2,776,554 | A | 1/1957 | Pigman |
| 2,822,442 | A | 2/1958 | Jones |
| 2,918,016 | A | 12/1959 | Olson |
| 2,971,467 | A | 2/1961 | Konopka et al. |

(Continued)

FOREIGN PATENT DOCUMENTS

JP 2002130140 A * 5/2002

OTHER PUBLICATIONS

Jp2002130140 abstract;May 2002;Japan;Murata et al.*

*Primary Examiner* — Devon Kramer
*Assistant Examiner* — Amene Bayou
(74) *Attorney, Agent, or Firm* — Smith Gambrell & Russell LLP

(57) ABSTRACT

A condensate pump for an HVAC system includes a reservoir for collecting condensate water, a pump motor connected to an impeller pump for pumping the condensate water out of the reservoir, and a floatless pump control module. The floatless pump's microcontroller detects the water level in the reservoir and, based on the water level in the reservoir, controls the operation of the pump motor, and if necessary, sounds an alarm and shuts down the HVAC system. The floatless pump microcontroller may employ an ultrasonic transducer or capacitance sensors to detect the level of condensate water in the reservoir. The microcontroller implements a variable water lift feature to pump the water using the lowest possible speed for the pump. The microcontroller implements a self-cleaning feature to pump stagnant water out of the reservoir and to pulse water in the drain line and the agitation of the water in the reservoir. The microcontroller implements an anti-clog feature to clear a clogged drain line when an overflow condition is detected.

55 Claims, 16 Drawing Sheets

(56) References Cited

U.S. PATENT DOCUMENTS

| | | | | | |
|---|---|---|---|---|---|
| 2,981,196 | A | | 4/1961 | Zimmermann et al. | |
| 3,696,629 | A | | 10/1972 | Heston | |
| 3,758,236 | A | * | 9/1973 | Zimmerman | 417/360 |
| 3,848,627 | A | * | 11/1974 | Page | 137/392 |
| 3,863,147 | A | | 1/1975 | Erath | |
| 4,061,442 | A | * | 12/1977 | Clark et al. | 417/36 |
| 4,182,363 | A | * | 1/1980 | Fuller | 137/392 |
| 4,370,098 | A | * | 1/1983 | McClain et al. | 417/18 |
| 4,436,486 | A | * | 3/1984 | Jensen et al. | 417/45 |
| 4,551,068 | A | * | 11/1985 | Boudreaux | 417/8 |
| 4,780,705 | A | | 10/1988 | Beane | |
| 4,875,497 | A | * | 10/1989 | Worthington | 137/2 |
| 4,881,873 | A | * | 11/1989 | Smith et al. | 417/12 |
| 4,888,989 | A | | 12/1989 | Homer | |
| 4,897,023 | A | | 1/1990 | Bingler | |
| 4,912,976 | A | | 4/1990 | Labriola, II | |
| 4,982,576 | A | | 1/1991 | Proctor et al. | |
| 5,012,768 | A | | 5/1991 | Roschinski | |
| 5,017,909 | A | | 5/1991 | Goekler | |
| 5,031,068 | A | | 7/1991 | Hansen et al. | |
| 5,035,581 | A | * | 7/1991 | McGuire et al. | 417/36 |
| 5,135,485 | A | | 8/1992 | Cohen et al. | |
| 5,188,710 | A | | 2/1993 | Weber et al. | |
| 5,201,339 | A | | 4/1993 | Buchan et al. | |
| 5,234,319 | A | * | 8/1993 | Wilder | 417/40 |
| 5,238,369 | A | * | 8/1993 | Farr | 417/18 |
| 5,265,482 | A | | 11/1993 | Davis et al. | |
| 5,461,879 | A | | 10/1995 | Bolton et al. | |
| 5,498,914 | A | | 3/1996 | De Boer | |
| 5,562,003 | A | | 10/1996 | Lefebvre | |
| 5,651,259 | A | | 7/1997 | Twyman | |
| 5,667,362 | A | | 9/1997 | Murai et al. | |
| 5,722,290 | A | | 3/1998 | Kronberg | |
| 5,856,783 | A | | 1/1999 | Gibb | |
| 6,042,342 | A | | 3/2000 | Orian | |
| 6,106,225 | A | | 8/2000 | Enns | |
| 6,125,696 | A | | 10/2000 | Hannan et al. | |
| 6,192,752 | B1 | | 2/2001 | Blaine | |
| 6,322,326 | B1 | | 11/2001 | Davis et al. | |
| 6,341,944 | B1 | | 1/2002 | Butcher | |
| 6,372,126 | B1 | | 4/2002 | Reeves | |
| 6,451,271 | B1 | | 9/2002 | Hammonds | |
| 6,499,961 | B1 | | 12/2002 | Wyatt et al. | |
| 6,565,325 | B2 | | 5/2003 | Belehradek | |
| 6,568,264 | B2 | | 5/2003 | Heger | |
| 6,847,291 | B2 | | 1/2005 | Kemp | |
| 7,127,943 | B1 | | 10/2006 | Griffiths et al. | |
| 7,150,190 | B2 | | 12/2006 | Krufka et al. | |
| 7,264,449 | B1 | * | 9/2007 | Harned et al. | 417/36 |
| 7,421,896 | B2 | * | 9/2008 | Vanderzee | 73/304 C |
| 2002/0157465 | A1 | | 10/2002 | Marioni | |
| 2002/0176782 | A1 | | 11/2002 | Batchelder et al. | |
| 2007/0166169 | A1 | | 7/2007 | Venkatachari et al. | |
| 2007/0224050 | A1 | | 9/2007 | Ward | |
| 2008/0095638 | A1 | | 4/2008 | Branecky | |
| 2008/0229819 | A1 | | 9/2008 | Mayleben et al. | |
| 2009/0129939 | A1 | | 5/2009 | Hampton | |

* cited by examiner

CONDENSATE PUMP

CLAIM OF PRIORITY

This application is a continuation-in-part of U.S. patent application Ser. No. 11/277,445, filed Mar. 24, 2006, now abandoned which claims priority from U.S. Provisional Patent Application Ser. No. 60/665,533, filed on Mar. 24, 2005, which is incorporated herein in its entirety, this application is a continuation-in-part of U.S. patent application Ser. No. 12/190,212, filed Aug. 12, 2008, now abandoned which claims priority from U.S. Provisional Patent Application Ser. No. 60/956,741, filed on Aug. 20, 2007, which is incorporated herein in its entirety, and this application is a continuation-in-part of copending U.S. patent application Ser. No. 12/244,152, filed Oct. 2, 2008, which claims priority from U.S. Provisional Patent Application Ser. No. 60/976,962, filed on Oct. 2, 2007, which is incorporated herein in its entirety.

FIELD OF THE INVENTION

The invention relates to a condensate pump that collects condensate water from the evaporator of an HVAC system and pumps the condensate water to another location for disposal. More specifically, the condensate pump of the present invention includes a floatless water level sensors and a control module.

BACKGROUND OF THE INVENTION

A condensate pump is used in an HVAC system to collect condensate water from the evaporator of the HVAC system and to pump the condensate water through a drain line to a drain line outlet at a remote location for disposal. The drain line outlet is usually elevated above the condensate pump. Particularly, the condensate pump typically comprises a reservoir, an impeller pump for pumping the water out of the reservoir to the remote location through the drain line, and an electric motor to drive the impeller pump. Conventionally, a float detects the level of condensate water in the reservoir and activates control switches to control the operation of the electric motor and if necessary, to sound an alarm or shut off the HVAC system.

Condensate pumps are often located in extreme environments and subjected to moisture, heat, and cold. Moreover, condensate pumps are often installed in inaccessible locations where maintenance is difficult, and therefore reliability over many years is necessary. Further, the condensate pump should operate quietly and without excessive buildup of heat from the operation of the electric motor. In addition, the condensate pump should be able to inhibit the build up of slime and algae in the reservoir and drain line. The condensate pump should be able to break up clogs in the drain line. A condensate pump should also be able to detect an emergency near overflow condition, trigger alarms, and shut down the HVAC system if necessary.

In a conventional condensate pump, a mechanical float monitors and detects the water level within the reservoir. In response to movement of the float within the reservoir, associated float switches and a float control circuitry control the operation of the electric pump motor, trigger alarms, or shut down the HVAC system if necessary. The condensate pump float is in contact with the water in the reservoir and is subject to fouling from debris and algae buildup. A molded float has seams, which may fail causing the float to sink or malfunction. The float switch that is used to control the on/off operation of the electric motor is often a specialized and costly bi-stable snap-action switch. A conventional condensate pump that incorporates a safety HVAC shut off switch and/or or an alarm switch, in addition to the motor control switch, may have a separate float or linkage to operate the HVAC shutoff switch or the alarm switch further complicating the condensate pump. Further, conventional condensate pumps often require a float mechanism retainer to prevent shipping damage, and the float mechanism retainer must be removed prior to pump use.

SUMMARY OF THE INVENTION

The present invention addresses the issues raised by the installation of a condensate pump in an extreme environment. Particularly, the condensate pump of the present invention is capable of operating quietly and reliably in such an extreme environment over an extended period of time without fouling of the reservoir or clogging of the drain line.

In order to achieve the objects outlined above, the condensate pump of the present invention includes a floatless water level sensing device which detects the water level within the reservoir and in response to detecting the water level in the reservoir, a microcontroller controls the operation of the electric pump motor, controls the operation of alarms, and if necessary, shuts down the HVAC system.

Specifically, in one embodiment, the floatless water level sensing device for the condensate pump of the present invention comprises an ultrasonic transducer (transmitter receiver) connected to the microcontroller. The microcontroller generates the ultrasonic frequency to drive the ultrasonic transducer. The ultrasonic signal produced by the ultrasonic transducer reflects off of the condensate water in the reservoir, and the ultrasonic transducer receives the reflected ultrasonic signal. The reflected ultrasonic signal is then connected from the ultrasonic transducer to the microcontroller. From the reflected ultrasonic signal, the microcontroller determines the level of the water in the reservoir and controls the electric pump motor, the alarms, and the shut down of the HVAC system.

In another embodiment of the floatless water level sensing device, one or more capacitance sensors are employed to detect the water level in the reservoir. As the water level in the reservoir changes, the capacitance of the capacitance sensor changes. The change in capacitance produces an output signal that is connected to the microcontroller. The microcontroller determines the level of the water in the reservoir based on the signal from the capacitance sensor and controls the electric pump motor, the alarms, and shut down of the HVAC system.

The presence of the low cost microcontroller as part of a condensate pump control module results in numerous advantages. The motor control provided by the microcontroller is solid state thereby being completely silent and not subject to contact arcing, contact welding, or contact corrosion. The pump activation water levels are permanently stored in the memory of the microcontroller and are not subject to variation as may be the case with a mechanical float arm that bends or is otherwise damaged such as in shipment.

The presence of the low cost microcontroller as part of the condensate pump control module allows for additional features in the condensate pump that are not possible with mechanical floats and float switches. For example, the microcontroller can make and store precision time measurements, water level comparisons, pump and alarm output control parameters, and system metrics such as the number of pump starts. The microcontroller controls the operation of the high water safety switch, which shuts down the HVAC system when the water level in the reservoir exceeds the normal water level required to start the impeller pump, and the water level is near overflow. Particularly, the microcontroller operates the high water safety switch so that the HVAC system remains off until the condensate pump has completely emptied the reservoir. Further, the microcontroller may be programmed to impart a user selectable time delay (anti-short cycle) to delay the HVAC compressor start after a power interruption or after the microcontroller has shut down the HVAC system due to a near overflow water level in the reservoir. Additional information including pump model, date of manufacture, serial number, and initial performance can be programmed into the microcontroller during manufacturing product testing. In addition, a passive RF coil datalink or an infrared transmitter connected to the microcontroller allows for communication between the microcontroller and a service technician's computer terminal.

The microcontroller further implements a variable lift feature for the condensate pump. Particularly, the microcontroller assures that the electric pump motor operates at a minimum speed necessary to lift the condensate water from the reservoir to the height of the drain line outlet. By controlling the speed of the electric motor to the lowest speed necessary to lift the condensate water to the drain line outlet, quiet operation and longer pump life is achieved.

The microcontroller further implements a stagnant water feature by which the microcontroller initiates the pumping of stagnant water out of the reservoir after a predetermined time has expired with the water level in the reservoir above a low water (empty) level but below the intermediate water (run) level necessary to start the ordinary pump down cycle. In addition, at predetermined times, the microcontroller initiates a cleaning cycle during which the pump motor runs at rapidly changing speeds to pulse water through the drain line and to agitate the water in the reservoir. The pulsing water in the drain line and the agitation of the water in the reservoir inhibits the build up of scale and slime in the drain line and the reservoir.

The microcontroller also implements an anti-clog drain line feature. Particularly, when a near overflow water level condition is detected, the most likely cause is a clogged drain line. When the near overflow water level condition is detected, not only does the microcontroller shut down the HVAC system and sound an alarm, the microcontroller attempts to unclog the drain line by increasing the speed of the pump motor and thereby increasing the output pressure from the impeller pump and by pulsing the discharge water into the drain line. If the drain line is successfully cleared, the microcontroller returns to its normal operation of discharging the condensate water through the drain line and once a normal water level is reached in the reservoir, the microcontroller restarts the HVAC system, after an appropriate time delay, and cancels the alarm.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
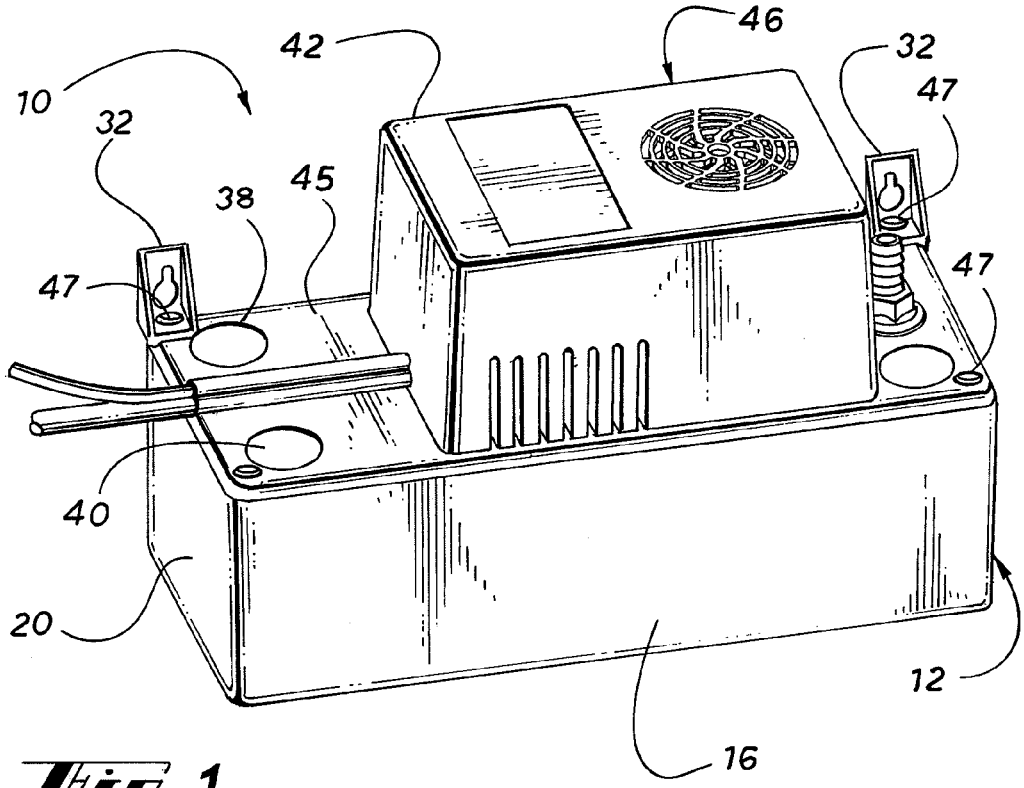
FIG. 1 is a front perspective view of a condensate pump in accordance with the present invention.
Figure 2:
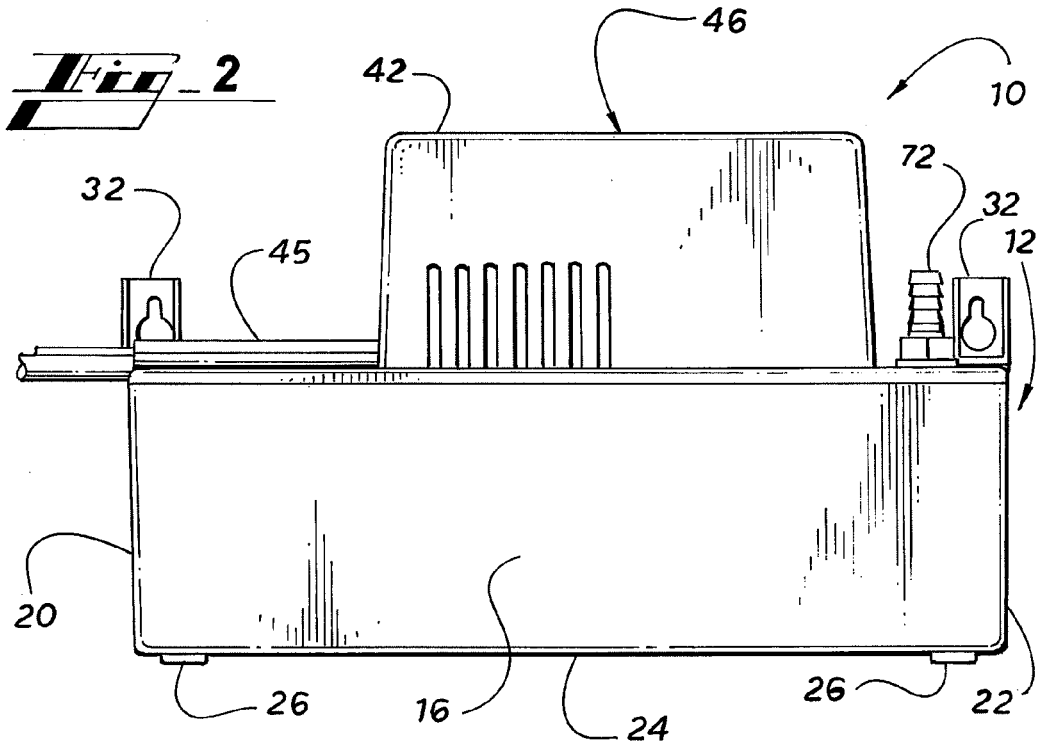
FIG. 2 is a front elevation view of the condensate pump in accordance with present invention.
Figure 3:
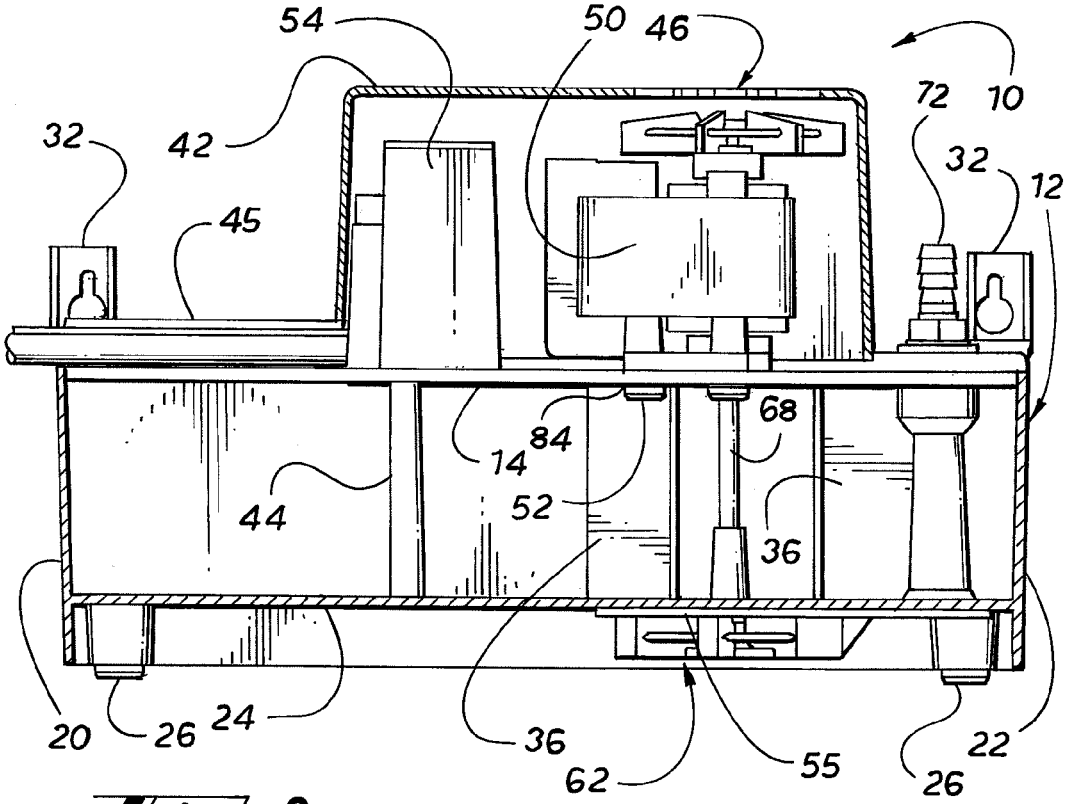
FIG. 3 is a front elevation view of the condensate pump (with the reservoir and cover cut away) in accordance with the present invention.
Figure 4:
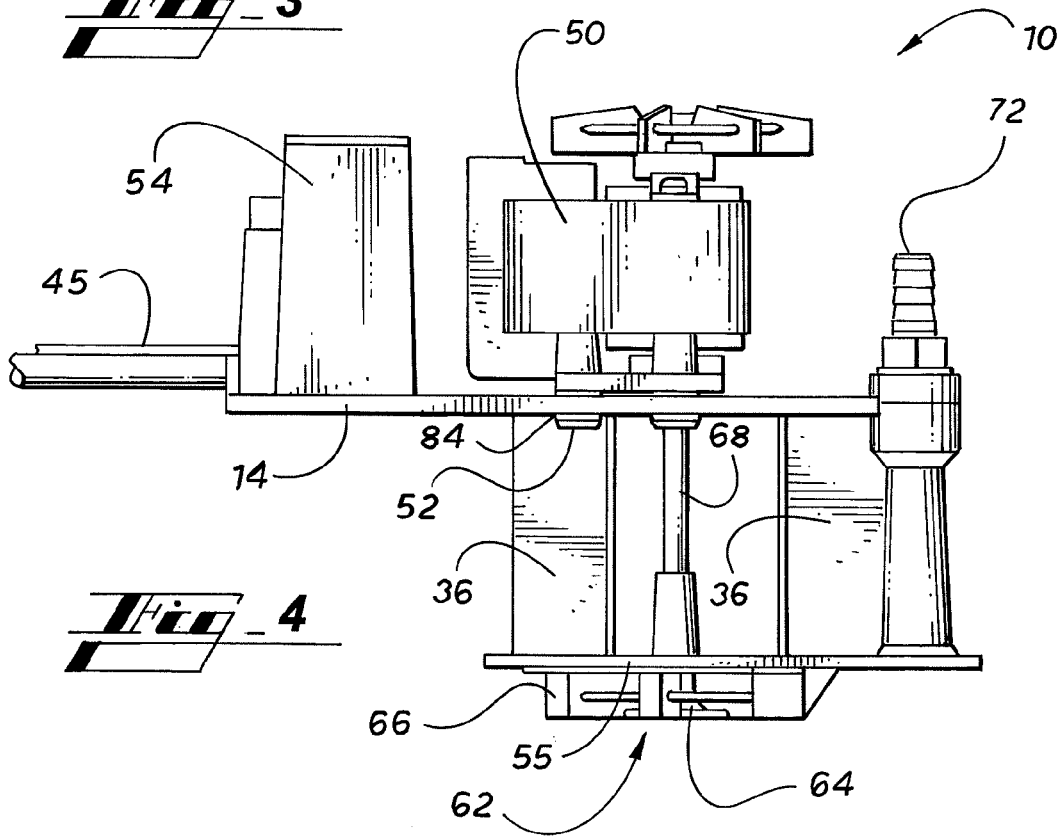
FIG. 4 is a front elevation view of the condensate pump (with the reservoir and cover removed) in accordance with the present invention.
Figure 5:
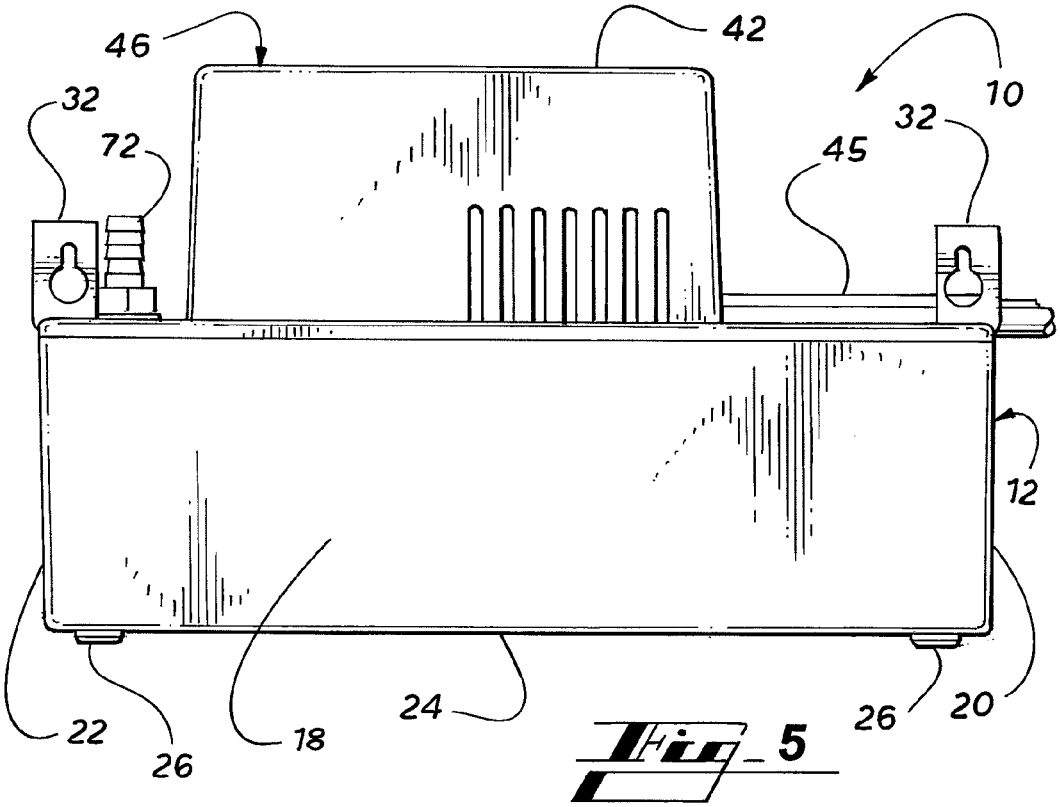
FIG. 5 is a back elevation view of the condensate pump in accordance with present invention.
Figure 6:
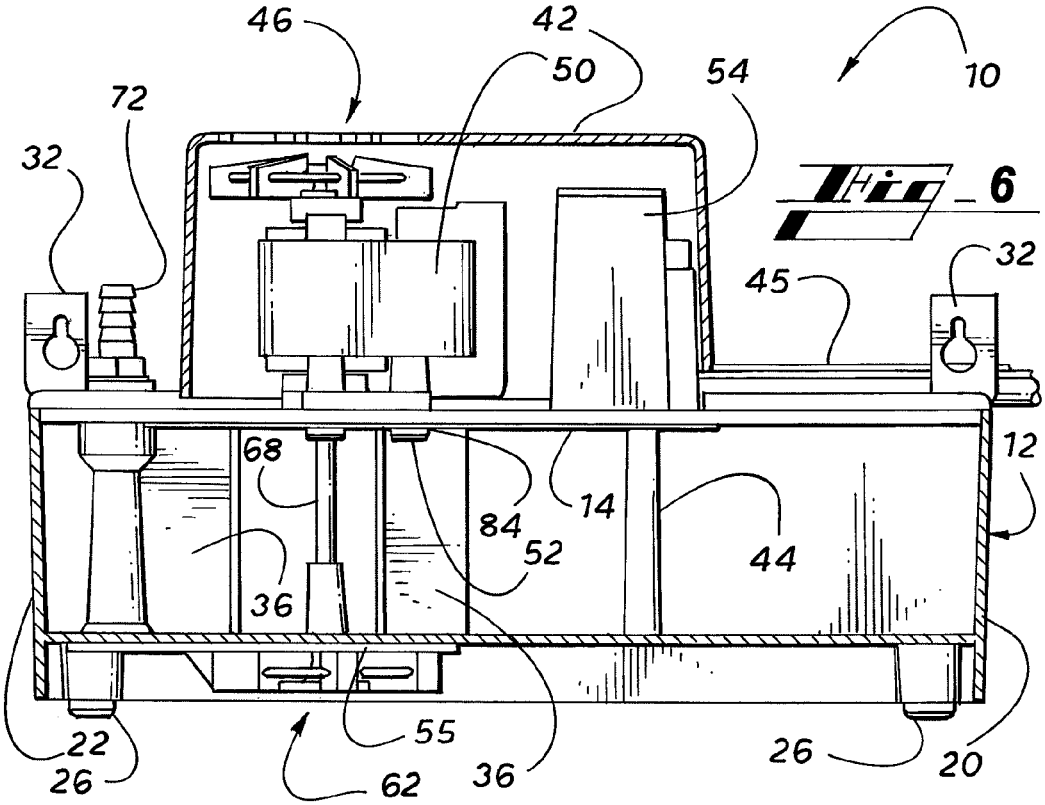
FIG. 6 is a back elevation view of the condensate pump (with the reservoir and cover cut away) in accordance with the present invention.
Figure 7:
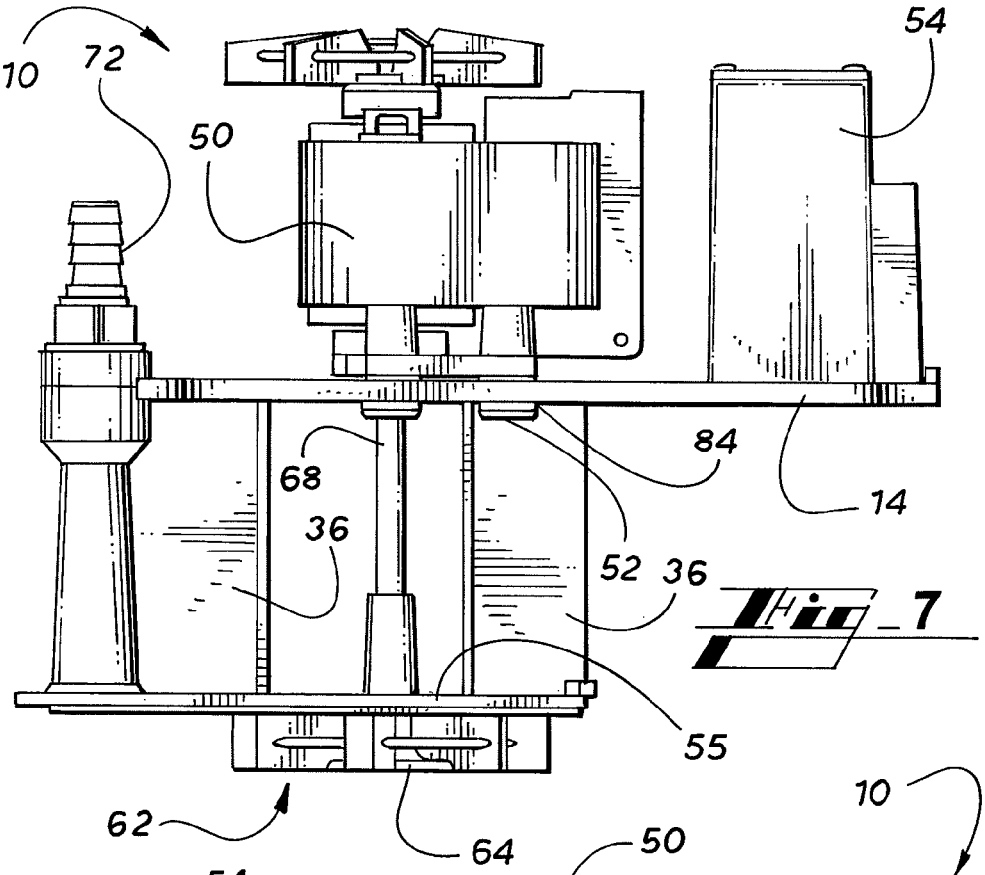
FIG. 7 is a back elevation in view of the condensate pump (with the reservoir and cover removed) in accordance with the present invention.

Turning to FIG. 1-7, a condensate pump 10 in accordance with the present invention comprises a reservoir 12, a top cover 46, and a support plate 14 (FIG. 4). The reservoir 12 comprises a water tight container with a front panel 16, a back panel 18, a left side panel 20, a right side panel 22, and a bottom panel 24. The reservoir may be of any geometric shape. The reservoir 12 has rubber support legs 26 located on the four corners of the bottom panel 24.

The top cover 46 comprises a cowl 42 and a flat base 45. The flat base 45 of the cover 46 is attached to the top of the reservoir 12 by means of cover screws 47. In addition, hanger brackets 32 are mounted to the reservoir 12 by means of the cover screws 47 adjacent the reservoir back panel 18. The hanger brackets 32 are used to mount the condensate pump 10 on a wall or other elevated support in order to make later access to the condensate pump 10 in some cases easier. The cowl 42 covers and protects a pump motor 50 and a control module 54. The flat base 45 of the cover 46 also has inlet openings 38 in the four corners of the flat base 45. Plugs 40 cover the inlet openings 38 that are not in use.

Figure 8:
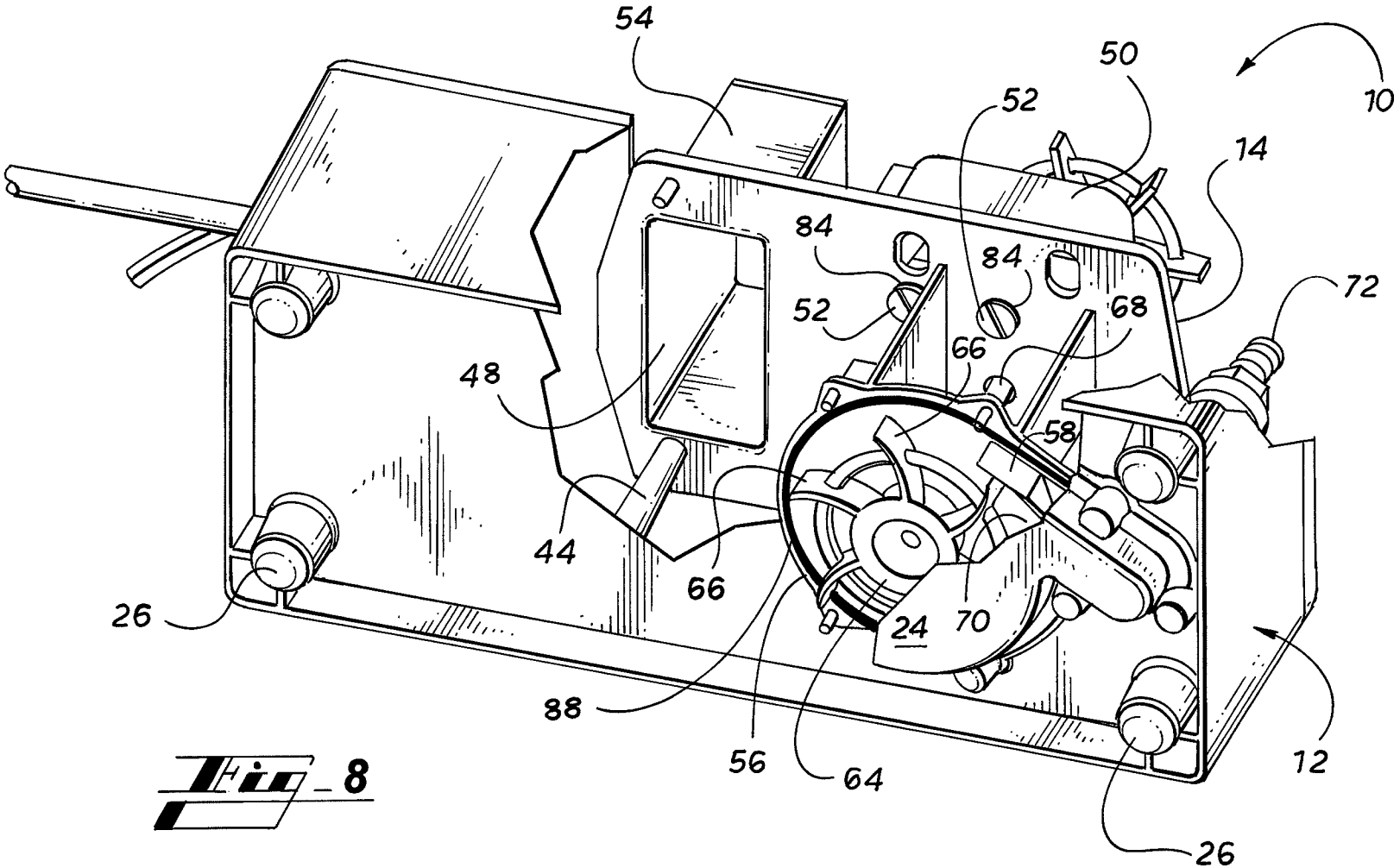
FIG. 8 is a bottom perspective view of the condensate pump (with the reservoir cut away) in accordance with the present invention.
Figure 9:
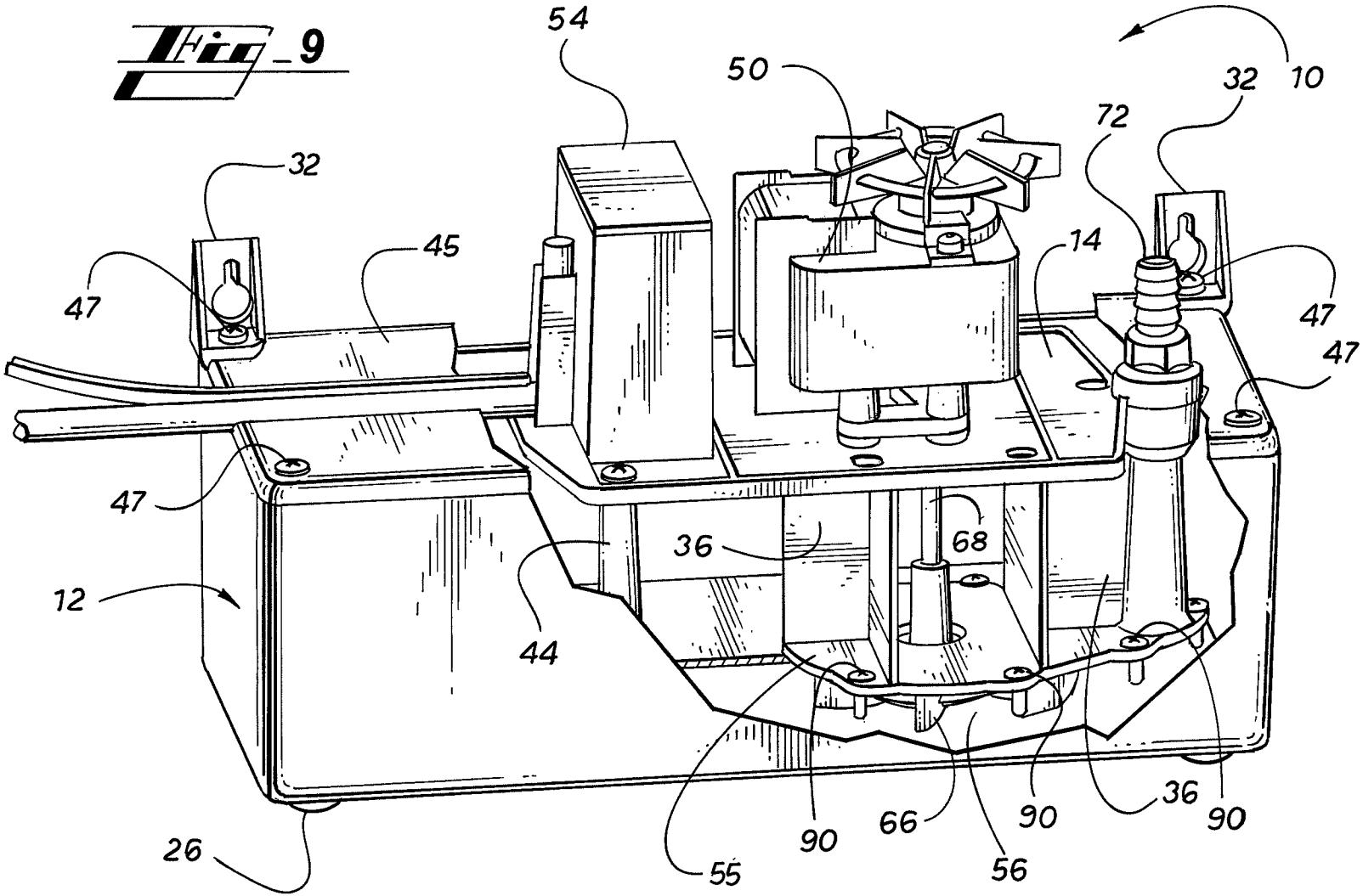
FIG. 9 is a top perspective view of the condensate pump (with the reservoir cut away and the cover removed) in accordance with the present invention.
Figure 11:
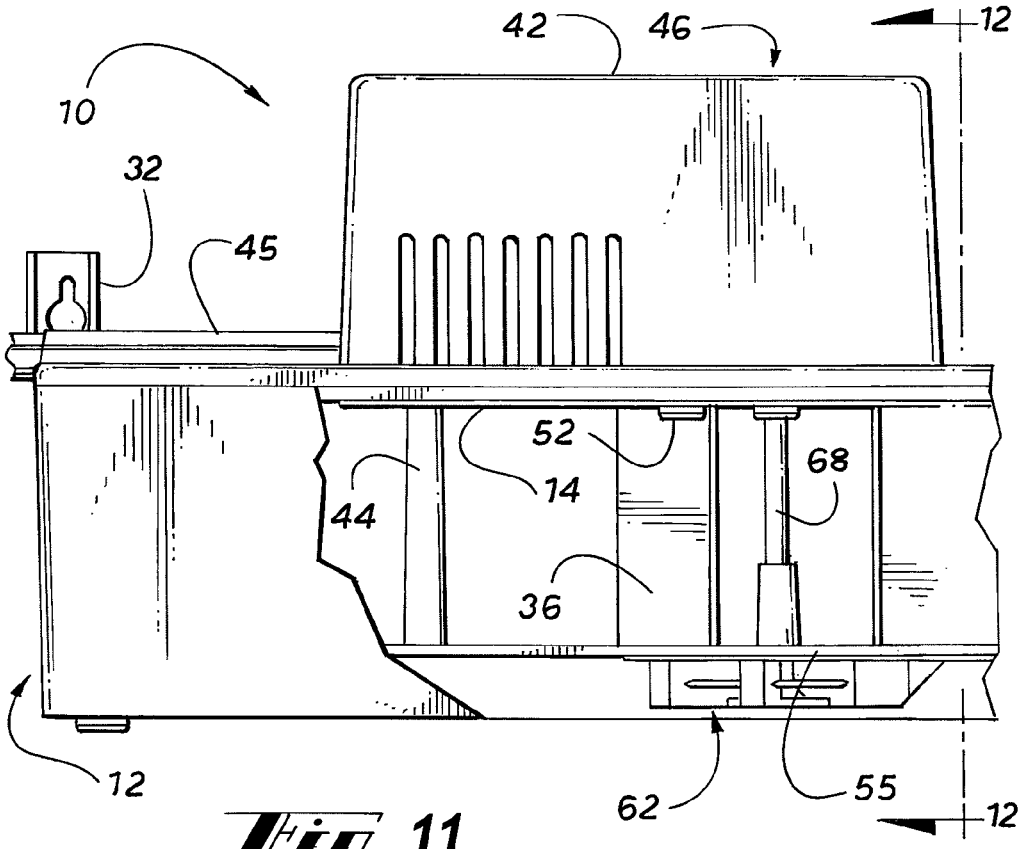
FIG. 11 is a partial front elevation view of the condensate pump (with a portion of the reservoir cut away) in accordance with the present invention.
Figure 12:
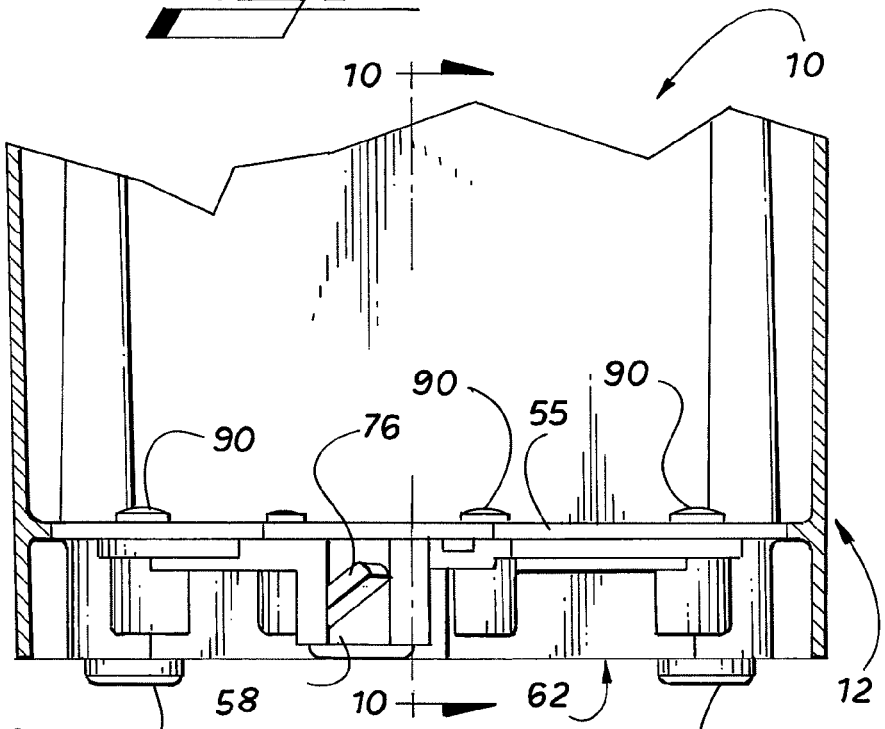
FIG. 12 is a side elevation cross-section view of the condensate pump in accordance with the present invention as seen along line 12-12 in FIG. 11.
Figure 13:
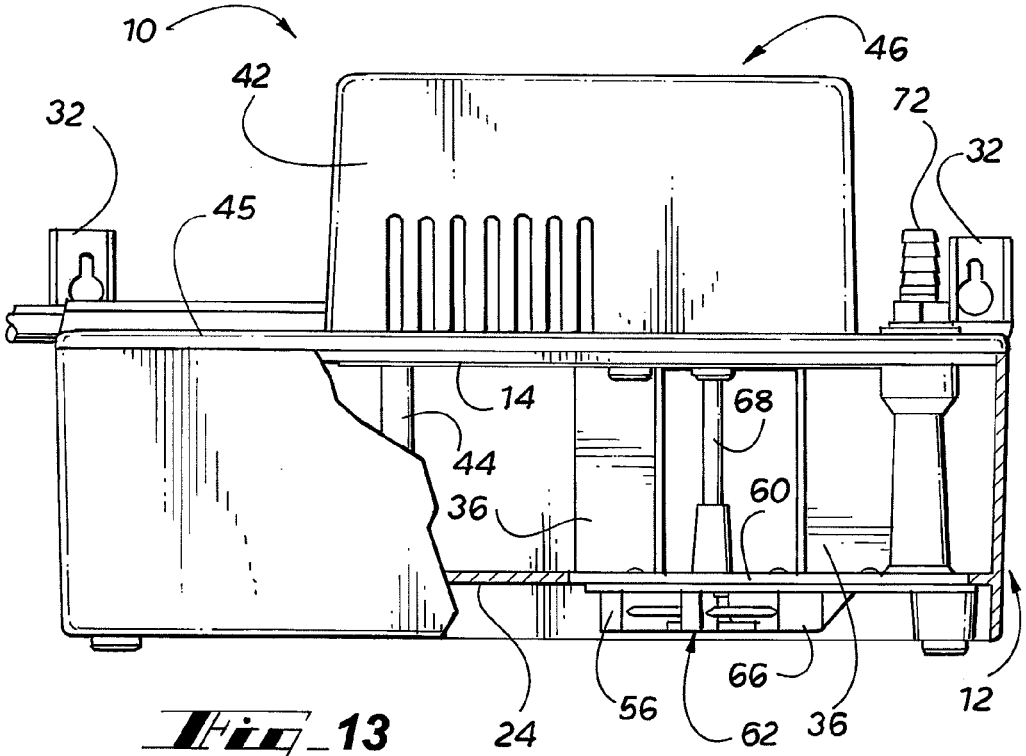
FIG. 13 is a front elevation view of the condensate pump (with a portion of the reservoir cut away) in accordance with the present invention.
Figure 14:
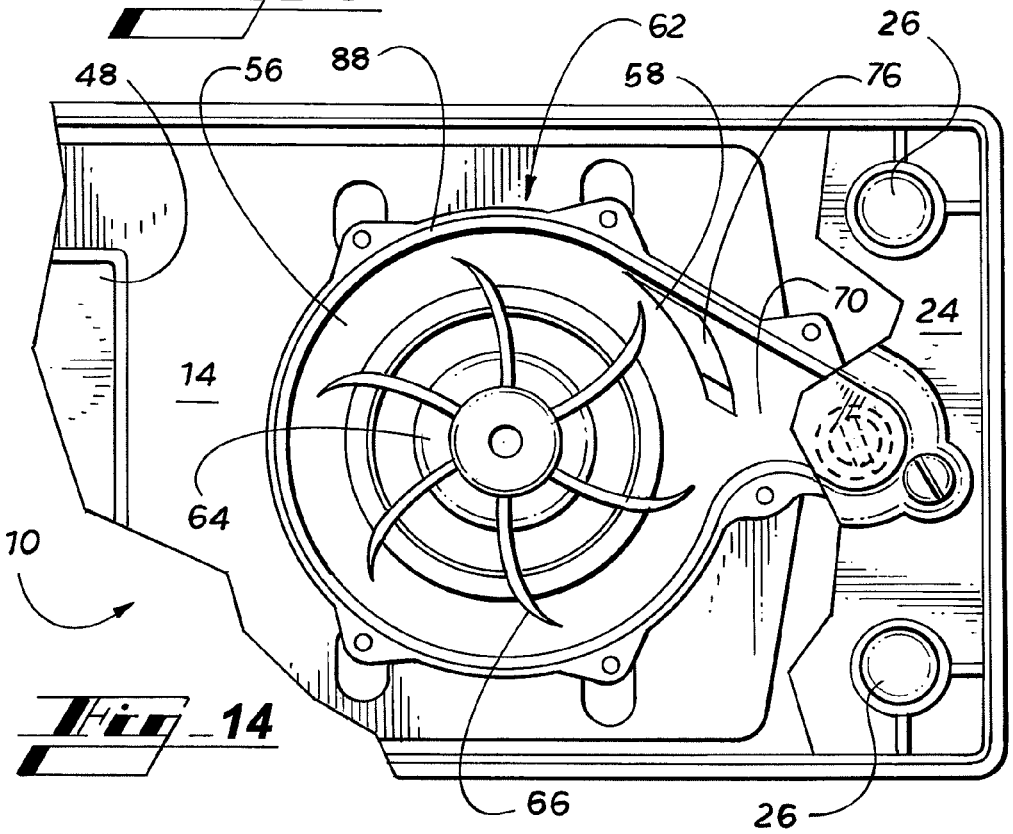
FIG. 14 is a bottom plan cross section view of the impeller pump of the condensate pump in accordance with the present invention as seen along line 14-14 in FIG. 13.

The support plate 14 forms a support backbone for the pump motor 50, the impeller pump 62, and the control module 54. A condensate water outlet connector 72 is mounted on one end of the support plate 14. A drain line (not shown) is connected to the outlet connector 72, and the drain line delivers condensate water through a drain line outlet to a remote location, typically above the elevation of the condensate pump 10. The outlet connector 72 includes a check valve so that water in the drain line cannot drain back into the reservoir 12. As shown best in FIGS. 4 and 7, the motor 50 is connected on top of the support plate 14 by means of pump motor screws 52, which include rubber isolation bushings 84. A volute chamber top 55 of the impeller pump 62 is connected to the support plate 14 by means of downwardly extending pump support legs 36 that are integrally molded with the support plate 14. The volute chamber top 55 is integrally molded with the support legs 36. The control module 54 is mounted on top of the support plate 14. An access opening 48 (FIG. 8) in the support plate 14 below the control module 54 allows an ultrasonic transducer 86 (FIG. 15) or a capacitance sensor array (FIG. 17, empty capacitance sensor 122, run capacitance sensor 124, and overflow capacitance sensor 126) to have acoustic or physical access to the interior of the reservoir 12. A driveshaft 68 extends between the pump motor 50 and the impeller pump 62.

In order to mount the support plate 14 within the reservoir 12, the reservoir 12 has a volute chamber 56 with a connecting output conduit 70 molded into the bottom panel 24 of the reservoir 12. In addition, the bottom panel 24 of the reservoir 12 has plate support legs 44 molded into and extending upwardly toward the support panel 14. The support plate 14, with its attached motor 50, pump support legs 36, and volute chamber top 55, is attached to and supported by the volute chamber 56 and the plate support legs 44. Particularly, the volute chamber top 55 is mounted on the volute chamber 56 by means of screws 90 and a gasket 88 in order to enclose the volute chamber 56 and the output conduit 70.

Figure 10:
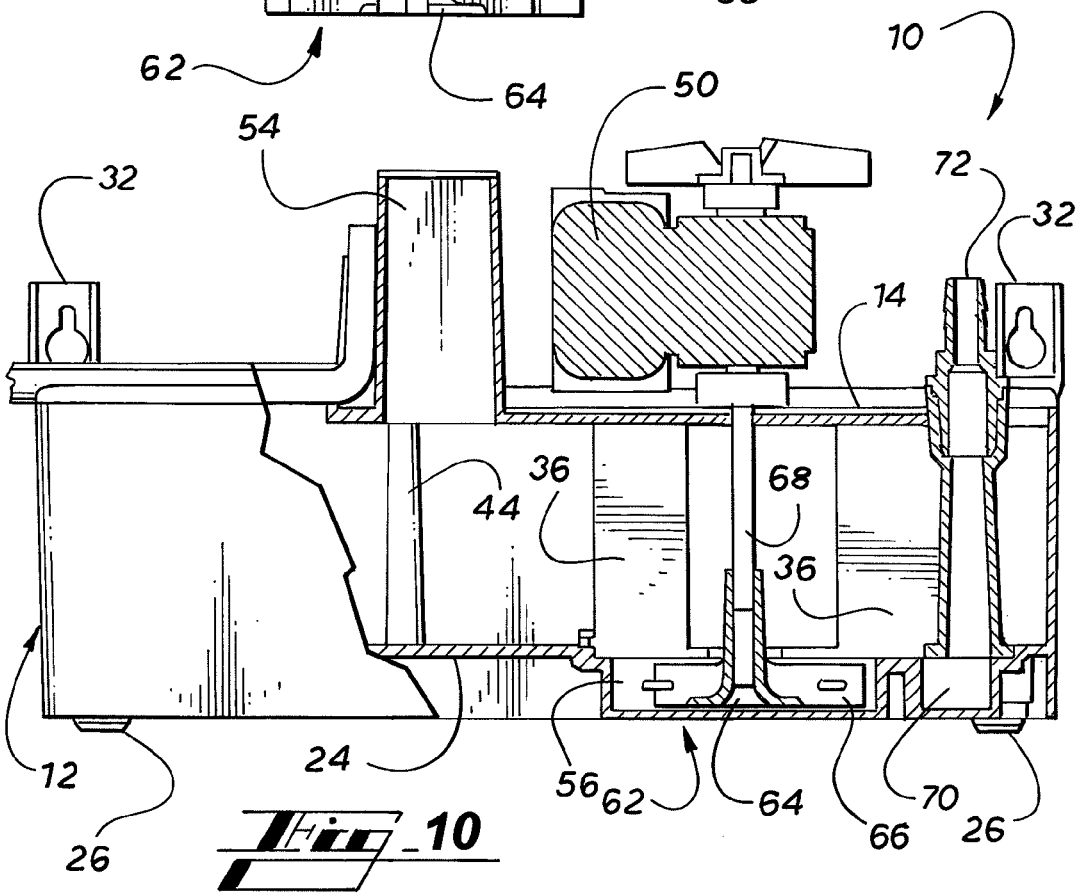
FIG. 10 is a front elevation cross-section view of the condensate pump in accordance with the present invention as seen along the line 10-10 in FIG. 12.

Turning to FIGS. 11-14, an impeller 64 with impeller blades 66 is mounted for rotation within the cylindrical volute chamber 56 of the impeller pump 62. The volute chamber 56 is cylindrical in shape with a central intake port 60 in the volute chamber top 55 (FIG. 10) and a tangential output port 58. The tangential output port 58 is connected to outlet conduit 70, and the outlet conduit 70 is connected to the water outlet connector 72. The impeller 64 is connected to impeller driveshaft 68 and is driven by the electric pump motor 50. In operation, the impeller 64 draws condensate water from the reservoir 12 into the central intake port 60 in the volute chamber top 55. The impeller 64 then forces the condensate water out through tangential output port 58, through the outlet tube 70, through the outlet connector 72, and the drain line.

In order to reduce noise of the impeller pump 62, the tangential output port 58 has swept diagonal surfaces 76, which are beveled in order to provide a smooth and elongated transition from the radial motion of the water between each of the impeller blades 66 to the tangential direction of the tangentially directed output port 58. Absent the smooth and elongated transition created by the swept diagonal surfaces 76, the water in a conventional impeller pump is forced to change direction immediately from a radial direction to a tangential direction causing a pronounced pounding sound as each impeller blades 66 passes by the tangentially directed output port 58. By smoothing and elongating the transition, the water gradually changes direction from radial to tangential thereby resulting in far less pump noise.

The condensate pump control module 54 detects the level of condensate water in the reservoir 12 and controls the operation of the pump motor 50, sounds an alarm if necessary, and shuts off the HVAC system if necessary. Particularly, when the condensate water is at a low (empty) water level, the control module 54 stops the pump motor 50. When the condensate water reaches a intermediate (run) water level, the control module starts the pump motor 50 so that the impeller pump 62 can pump the condensate water out of the reservoir 12. Once the condensate water level returns to the low (empty) water level in the reservoir 12, the control module 54 again stops the pump motor 50. In the case of a condensate pump failure, such as a clogged drain line, the water in the reservoir 12 may rise to a near overflow water level indicating an overflow condition may occur. When the control module 54 detects that the water has risen to the near overflow water level in the reservoir 12, the control module 54 increases the speed of the pump motor 50 (or alternatively rapidly varying the speed of the pump motor 50 to cause pulsing of the water in the drain line), sounds an alarm, and shuts down the HVAC system if necessary. In other embodiments described below, the control module 54 also controls the speed of the pump motor 50, and therefore the impeller pump 62, to provide a variable elevation lift for the condensate water depending on the elevation of the outlet of the drain line, controls a cleaning mode to inhibit the formation of slime and scale and to unclog a clogged drain line, and controls the evacuation of stagnant water from the reservoir 12.

Figure 15:
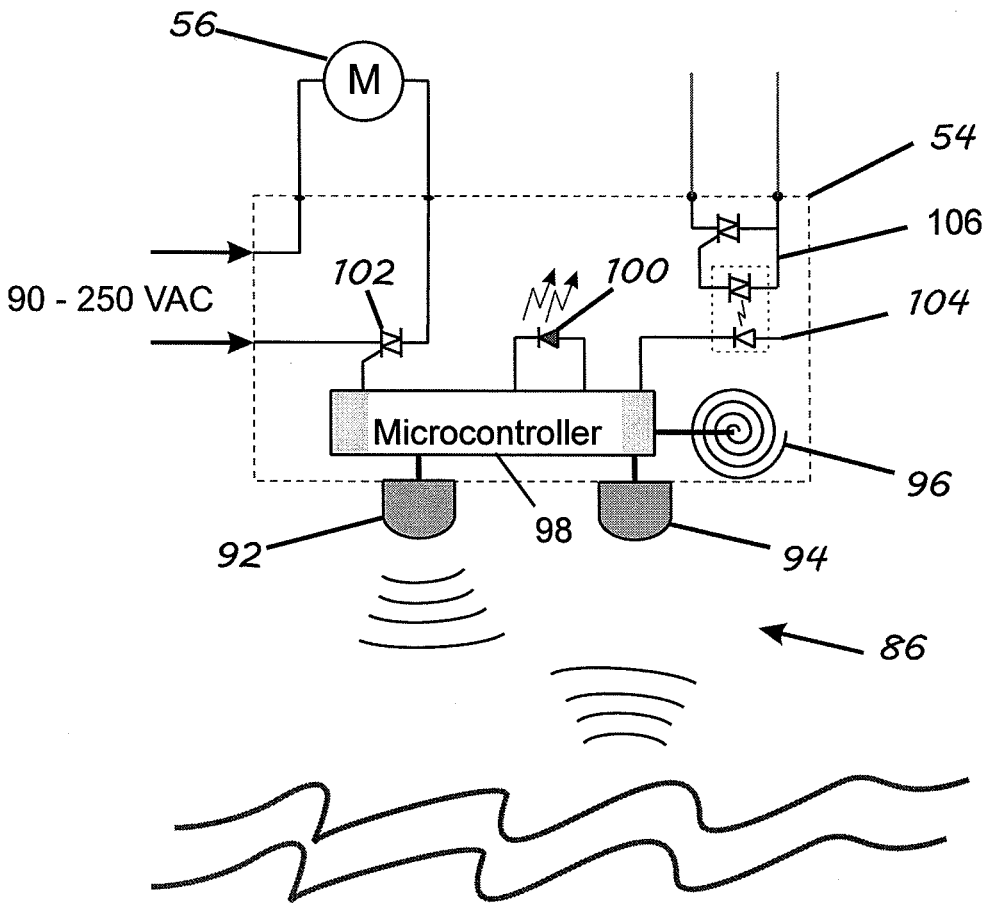
FIG. 15 is a schematic of a floatless condensate pump control module employing an ultrasonic transducer (transmitter receiver) in accordance with the present invention.

Turning to FIG. 15, the control module 54 includes a printed circuit board that holds and interconnects all the components including the ultrasonic transducer 86 (including ultrasonic transmitter 92 and ultrasonic receiver 94), a power supply (not shown), a microcontroller 98, a solid-state motor control switch 102, a high water alarm switch 104, and a high water safety switch 106 for controlling the HVAC system. The microcontroller 98 generates an ultrasonic signal that drives the ultrasonic transmitter 92. The ultrasonic transmitter 92 in turn produces an ultrasonic output signal directed into the reservoir 12 through the access opening 48 in the support plate 14. The microcontroller 98 also receives an ultrasonic echo signal from the ultrasonic receiver 94. The microcontroller 98 processes the ultrasonic signal from the ultrasonic receiver 94 to determine the level of the condensate water in the reservoir 12. As the condensate water rises in the reservoir 12, the time between the "ping" from the ultrasonic transmitter 92 and the echo received by the ultrasonic receiver 94 becomes shorter. The times between ping and echo are approximately: 600 usec for the low water level (empty reservoir), 400 usec for the intermediate water level (full reservoir), and 300 usec for the near overflow water level (near overflow condition).

The microcontroller 98 also allows for monitoring and processing various metrics concerning the operation of the condensate pump 10, such as for example precision time measurement, water level comparison, pump motor and alarm output control, and the number of pump starts. The microcontroller 98 is also connected to a light emitting diode 100 that can be used to flash diagnostic codes for a service technician. Additional information including pump model, date of manufacture, serial number, and initial performance can be programmed into the microcontroller 98 during manufacturing product testing to be used for later tracking and diagnostic purposes.

The control module 54 also has a passive RF coil datalink 96 connected to the microcontroller 98 so that data compiled by the microcontroller 98 can be downloaded to a service technician's computer terminal. The passive RF coil datalink 96 enables bidirectional radio frequency communication of operational status and manufacturing information from the pump and provides a data path to and from the microcontroller 98 for loading and downloading operational set points into the microcontroller 98 during pump manufacture and subsequent service operations.

The control module 54 with its microcontroller 98, ultrasonic transducer 86, and solid-state switches 102, 104, and 106 produces numerous benefits that are not available with a conventional float mechanism. Particularly, ultrasonic transducer 86 with its transmitter 92 and receiver 94 does not touch the condensate water in the reservoir 12. Consequently, there are no floats or moving parts to foul or break. Because of control module 54 utilizes a solid-state switch 102 to control the motor 50, motor control is completely silent, and there are no switch contacts that can arc or weld. Use of the microcontroller 98 allows the pump activation water levels (low, intermediate, and near overflow) to be stored in permanent memory. Consequently, there are no float arms to bend and shipping damage to float switch that can affect performance of the condensate pump 10.

The microcontroller 98 also controls an LED indicator 100 so that the LED indicator 100 blinks codes indicating for example system power, timer operation, pump run, and alarm conditions. The microcontroller 98 is programmed so that the safety switch 106 shuts down the HVAC system when the condensate water is at the near overflow water level, and the safety switch 106 keeps the HVAC system down until the impeller pump 62 completes a full pumping cycle, and the condensate water level has reached the low water level (reservoir empty). The microcontroller 98 can also be programmed as an anti-short cycle timer. The anti-short cycle timer may be used to delay start of the HVAC compressor after a power interruption or operation of the safety switch 106 so that the HVAC compressor is automatically protected against compressor short cycling. The microcontroller 98 may also be programmed so that the safety switch 106 is automatically opened on loss of power to condensate pump 10.

When power is first applied to the condensate pump 10, the safety switch 106 and motor switch 102 are open (off). If the microcontroller 98 is programmed for a time delay start of the HVAC system, the time delay begins, and the LED indicator 100 flashes the timer code of two blinks as indicated in Table 1 below (anti-short cycling time is operating-pump off) until the time delay is complete. Once the time delay has elapsed, the microcontroller 98 closes the safety switch 106 to start the HVAC system, the pump motor 50 remains off, and the LED indicator 100 shows solid (power on, pump not operating). Once the condensate water reaches the intermediate (run) water level, the signal from the ultrasonic receiver 94 causes the microcontroller 98 to start the pump motor 50, and the LED indicator 100 slowly flashes (pump running, normal pump down cycle). Once the condensate water reaches the low (empty) water level again, the microcontroller 98 opens motor control switch 102 to stop the pump motor 50, and the LED indicator 100 returns to the solid blink code.

If the condensate water reaches the near overflow water level, the microcontroller 98 causes the pump motor 50 to continue running, shuts down the HVAC system, and causes the LED indicator 100 to blink rapidly (pump running, alarm level). When the condensate water again reaches the low (empty) water level, the microcontroller 98 starts the anti-short cycle timer so that the restart of the HVAC system is delayed.

TABLE 1

| Condition | Blink Code | Motor Switch 102 | Safety switch 106 |
|---|---|---|---|
| Power On, Pump Not Operating | ********** (solid on) | open | closed |
| Anti-short-cycle timer operating-Pump Off | *-*----------(2 Blinks) | open | open |
| Anti-short-cycle timer operating-Pump On | *-*-*----------(3 Blinks) | closed | open |
| Pump Running, Norm Pumpdown Cycle | ***-----***-----(Slow Flashing) | closed | closed |
| Pump Running, Alarm Level | *-*-*-*-*-*-*-*-(Rapid Blinking) | closed | open |

Figure 16:
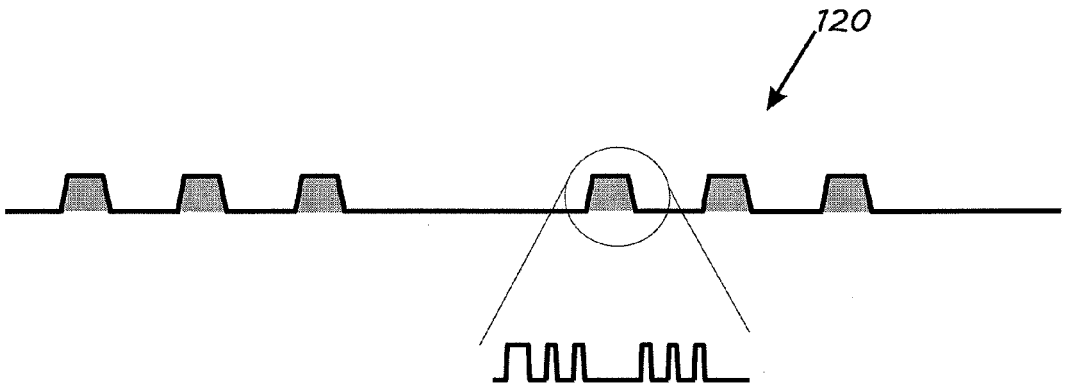
FIG. 16 is a schematic of a communication circuit for the floatless condensate pump control module employing the ultrasonic transducer in accordance with the present invention.
Figure 16:
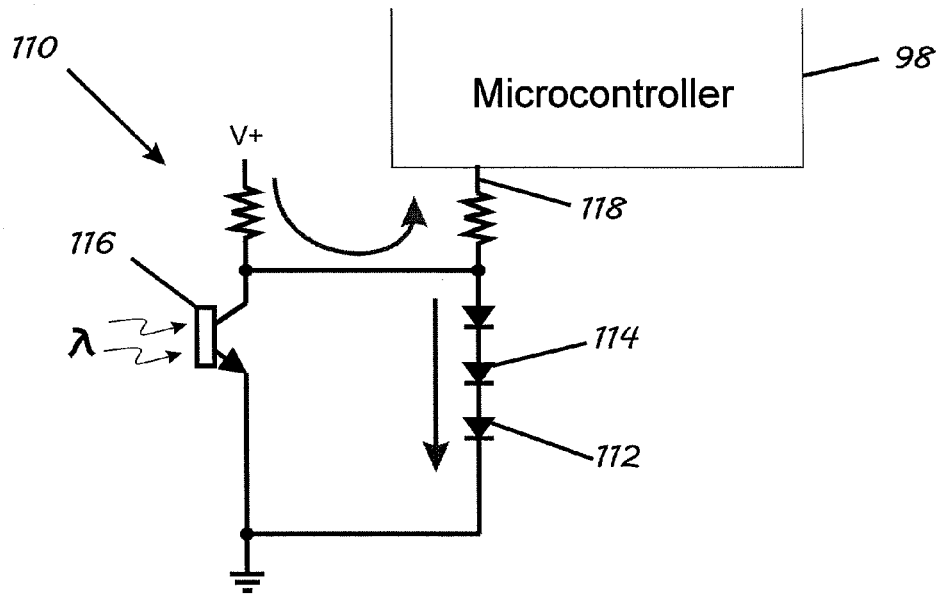

FIG. 16 discloses an LED communication circuit 110 that may be used as an alternative to the passive RF coil datalink 96 shown in FIG. 15. Instead of the passive RF coil datalink 96, the microcontroller 98 is connected to the LED communication circuit 110 so that data compiled by the microcontroller 98 can be downloaded to a service technician's computer terminal and so that service parameters can be programmed into the condensate pump from the technician's computer terminal.

The LED communication circuit 110 of the floatless condensate pump control module 54 includes a visible light emitting LED 112, an infrared emitting LED 114, and an infrared sensitive phototransistor 116 connected to a single input/output pin 118 of the microcontroller 98. The visible LED 112, the infrared LED 114, and infrared phototransistor 118 are electrically arranged to simultaneously emit visible and invisible information regarding operation of the condensate pump 10. During the visibly ON periods of the visible LED 112, blink codes 120 containing high speed serial data are integrated by the operator's eye into single easily detectible blinks of the visible LED 112 while the embedded infrared pulses remain detectible to remote pump diagnostic equipment. The infrared photo detector 116 collects serial data and commands from externally located computer terminal, and infrared photo detector 116 is biased in order to generate a signal at the input/output pin 118 of the microcontroller 98 during LED dark periods. Consequently, the infrared photo detector 116 can be used to load operating parameters into the microcontroller 98. Such operating parameters may include, among others, manufacturing data such as serial numbers, and date of manufacture and may be used to stimulate latent diagnostic and operational modes as well as setting operational parameters including water levels, time delays and alarm trip points.

Figure 17:
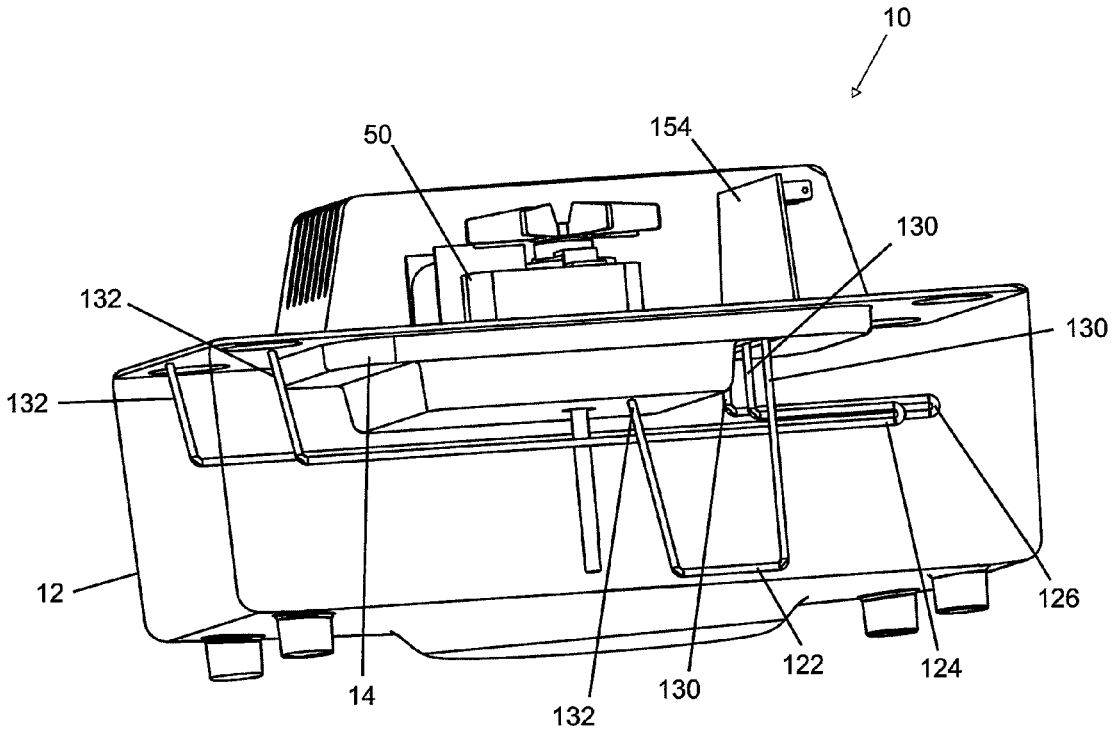
FIG. 17 is a perspective view of a capacitance sensor array (with the reservoir transparent) for the floatless condensate pump control module in accordance with the present invention.

In an alternative embodiment of the condensate pump 10, a capacitance sensor system, such as capacitance sensor systems 140 and 240 (FIGS. 18 and 19), is employed to determine the level of water in the reservoir 12 and thereby control the operation of the pump motor 50 and, if necessary, control an alarm and the HVAC system. The capacitance sensor system 140 has a control module 154 (FIG. 18), and the capacitance sensor system 240 has a control module 254 (FIG. 19). Turning to FIG. 17, the support plate 14 supports the control module (such as control module 154), the empty capacitance sensor 122, the run capacitance sensor 124, and the near overflow capacitance sensor 126. Each capacitance sensor 122, 124, or 126 has a first end 130 connected to the control module (such as control module 154) and a second end 132 that is unconnected. The empty capacitance sensor 122 senses when the water in the reservoir 12 has reached a low water level so that the pump motor 50 can be turned off after a pump cycle. The run capacitance sensor 124 senses when the water in the reservoir 12 has reached the intermediate water level so that the pump motor 50 can be turned on to pump water out of the reservoir 12. The overflow capacitance sensor 126 senses when the water in the reservoir 12 has reached a critically near overflow water level so that the HVAC system can be turned off and an alarm activated while the pump motor 50 continues running.

Figure 18:
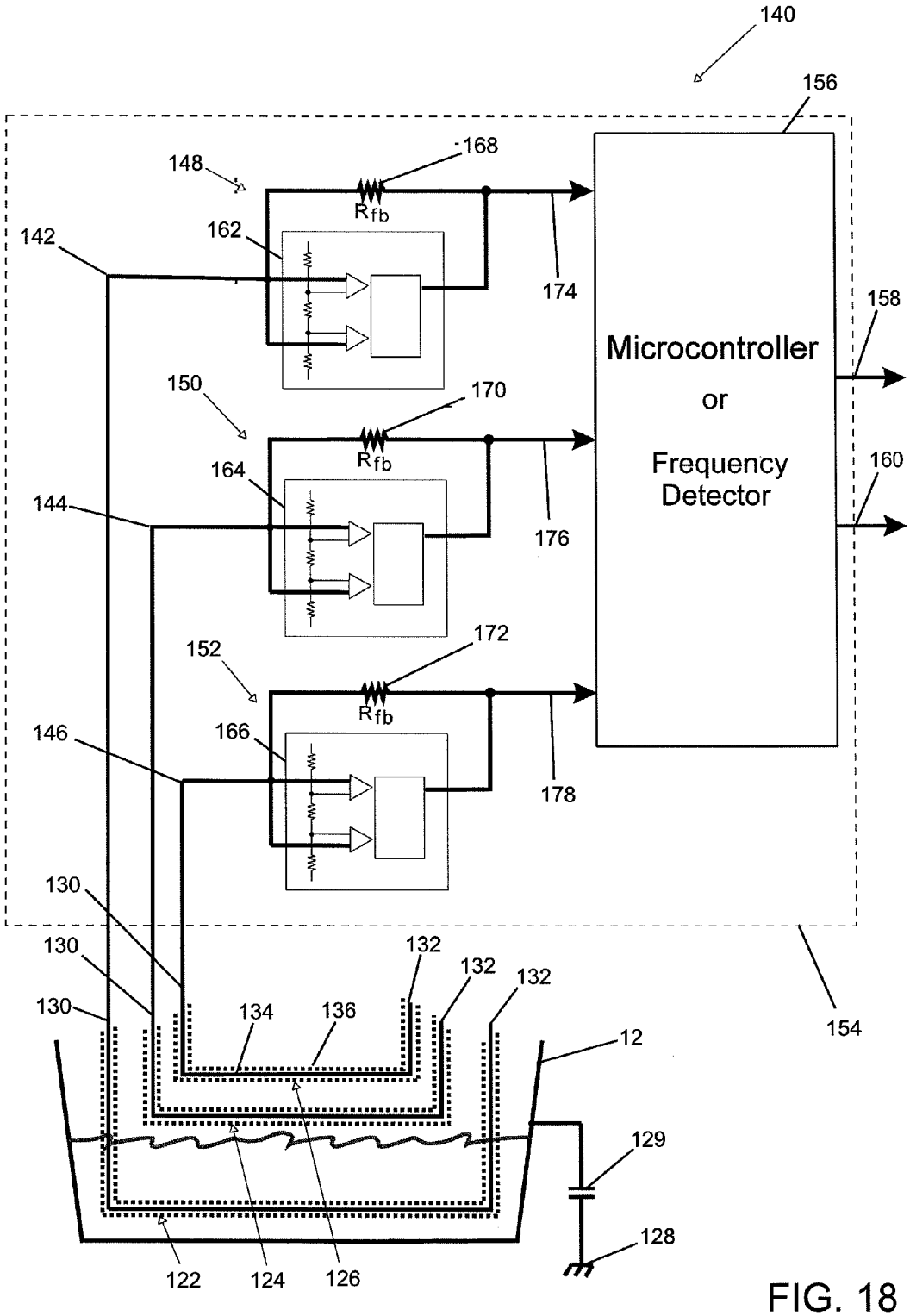
FIG. 18 is a schematic diagram of one embodiment of a capacitance sensor circuitry for the floatless condensate pump control module in accordance with the present invention.
Figure 19:
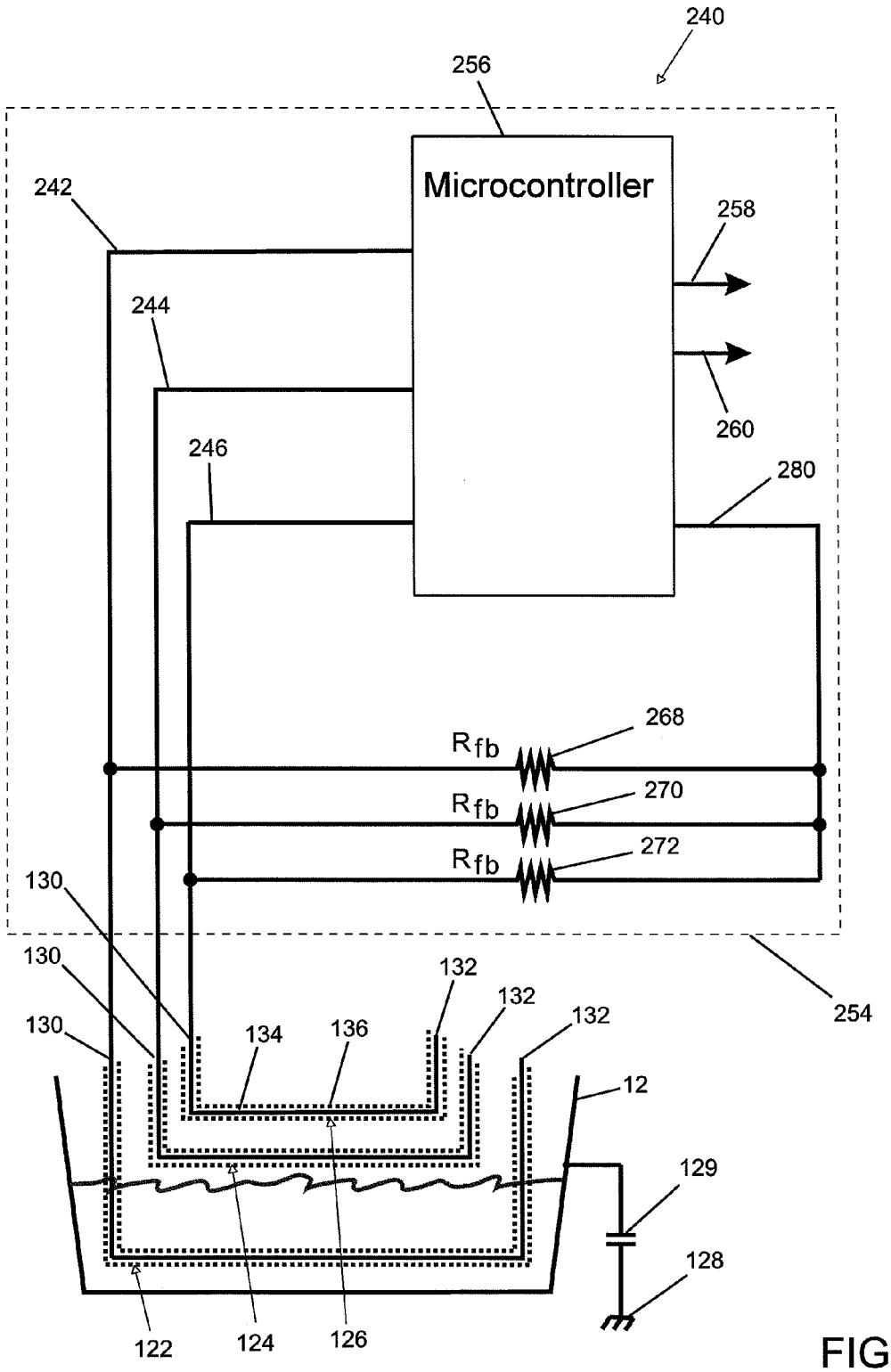
FIG. 19 is a schematic diagram of another embodiment of a capacitance sensor circuitry for the floatless the condensate pump control module in accordance with the present invention.

As shown in FIGS. 18 and 19, each of the capacitance sensors 122, 124, and 126 consists of a wire conductor 134 surrounded by insulation 136. The insulation 136 can be any appropriate electrical insulation that serves as a dielectric and does not deteriorate or become fouled when subjected to the condensate water in the reservoir 12. Polyvinyl chloride installation and polyethylene installation are both useful in carrying out the present invention. Polyethylene has the additional advantage of avoiding fouling by material attaching to it from the condensate water in the reservoir 12. One end 130 of each of the capacitance sensors 122, 124, and 126 is respectively connected to inputs 142, 144, and 146 of the control module 154 (FIG. 18), and the one end 130 of each of the capacitance sensors 122, 124, and 126 is respectively connected to inputs 242, 244, and 246 of the control module 254 (FIG. 19).

Each of the capacitance sensors 122, 124, and 126 represents one plate of a capacitor formed between the wire conductor 134 of each of the capacitance sensors 122, 124, and 126 and earth ground 128 (FIGS. 18 and 19). The total capacitance value at end 130 of each of the capacitance sensors 122, 124, and 126 is the value of the capacitance sensor plus the value of the distributed capacitance 129 associated with the reservoir 12. Because the dielectric constant of water is greater than the dielectric constant of air, the capacitance value of capacitance sensors 122, 144, and 126 increases dramatically when the condensate water in the reservoir 12 contacts the insulation 136 on the capacitance sensors 122, 124, and 126. That increase in capacitance, connected to the inputs 142, 144, and 146 of the control module 154 (FIG. 18) and connected to the inputs 242, 244, and 246 of the control module 254 (FIG. 19), is used by the microcontrollers 156 and 256 to control the pump motor 50 or, if necessary, to control the HVAC system or an alarm as will be described in greater detail in connection with FIGS. 18-20.

The capacitance sensors 122, 124, and 126 can be shaped to accommodate the physical requirements relating to the water level in the reservoir 12. For example, the empty capacitance sensor 122 can be shaped so that it extends to a point adjacent the intake 60 of the impeller pump 64 (FIG. 17). In that way, the empty capacitance sensor 122 can assure that the motor 50 shuts off before the intake 60 of the impeller pump 64 has been exposed to air instead of water in the reservoir 12. The run capacitance sensor 124 and the overflow capacitance sensor 126, on the other hand, are shaped so that they extend horizontally along the length of the reservoir 12. The elongated shape ensures that, if the condensate pump 10 is supported on a slanted surface, some portion of the run capacitance sensor 124 or the overflow capacitance sensor 126 is able to contact condensate water in the reservoir 12 before overflow occurs. The capacitance sensors could be bent into any shape to conform to the shape of the reservoir 12 or to focus on a particular volume within the reservoir 12.

In one embodiment of the condensate pump 10, the capacitance sensor system 140 or 240 includes the three separate capacitance sensors, the empty capacitance sensor 122, the run capacitance sensor 124, and the overflow capacitance sensor 126. Each capacitance sensor 122, 124, or 126 is connected to the control module 154 or 254. Alternatively, a single, vertically oriented capacitance sensor may be employed. As the condensate water level rises and falls along the length (height) of the vertically oriented capacitance sensor, the change in capacitance of the capacitance sensor is sufficient to allow the control module 154 or 254 to determine the level of condensate water in the reservoir 12. Alternatively, as described in greater detail below, a single capacitance sensor can use in connection with microcontroller timing calculations to determine the level of condensate water in the reservoir 12.

Turning to FIG. 18, the control module 154 comprises a low (empty) water oscillator 148, an intermediate (run) water oscillator 150, a high (overflow) water oscillator 152, and the microcontroller 156. In addition to the control module inputs 142, 144, and 146, the control module 154 has motor control output 158 and HVAC and alarm control output 160. The low (empty) water oscillator 148 includes a comparator 162, a feedback resistor 168, and an oscillator output 174. The intermediate (run) water oscillator 150 includes a comparator 164, a feedback resistor 170, and an oscillator output 176. The high (overflow) water oscillator 152 includes a comparator 166, a feedback resistor 172, and an oscillator output 178. The capacitance sensors 122, 124, and 126 are connected to the control module inputs 142, 144, and 146, which in turn are connected to the inputs of the comparators 162, 164, and 166. The outputs 174, 176, and 178 of the oscillators 148, 150, and 152 are connected to inputs of the microcontroller 156. FIG. 18 illustrates a capacitance sensor system 140 in which three separate capacitance sensors 122, 124, and 128 are employed. If a single capacitance sensor is used, oscillators 150 and 152 may be eliminated.

In operation, the capacitance value at the control module input, such as input 142 determines the frequency of the oscillator 148. If, for example, the empty capacitance sensor 122 is in contact with the condensate water in the reservoir 12, the value of the capacitance at control module input 142 increases, and the additional capacitance at control module input 142 causes the oscillator 148 to oscillate at a reduced frequency. If the oscillator frequency is below a certain predetermined threshold level, the microcontroller 156 recognizes that low frequency as an indication that the capacitance sensor 122 is in contact with condensate water in the reservoir 12. In the embodiment where three capacitance sensors 122, 124, and 126 are employed with separate oscillators 148, 150, and 152, the microcontroller 156 responds to the change in frequency at each of its three inputs 174, 176, and 178. For example, when the condensate water in the reservoir 12 is below the low water and none of the three capacitance sensors 122, 124, and 126 is in contact with the condensate water, all three individual oscillators 148, 150, and 152 are running at a relatively high frequency because the dry capacitance sensors have a low capacitance value. As a result, the microcontroller 156 recognizes that circumstance as a low (empty) water level condition and turns off the pump motor 50 by means of a signal on motor control output 158 connected to pump motor switch 102. At the same time, the microcontroller 156 maintains the alarm inactive and maintains the operation of the HVAC system by means of a signal on HVAC and alarm output 160 connected to alarm switch 104 and safety switch 106. When the condensate water reaches the run capacitance sensor 124, the inputs 174, 176, and 178 connected to the microcontroller 156 include a low frequency signal on line 174 from the low (empty) water oscillator 148 connected to the low (empty) water capacitance sensor 122, a low frequency signal on line 176 from the intermediate (run) water oscillator 150 connected to the run capacitance sensor 124, and a high frequency signal on line 178 from the high (overflow) water oscillator 152 connected to the overflow capacitance sensor 126. Based on that set of inputs, the microcontroller 156 turns on the pump motor 50 by means of a signal on motor control output 158 and maintains the operation of the HVAC system and the continued deactivation of the alarm by means of the signal on HVAC and alarm output 160. When the condensate water reaches the overflow capacitance sensor 126, the inputs 174, 176, and 178 connected to the microcontroller 156 all have a high frequency value indicating in that the reservoir 12 may be close to overflowing. The microcontroller 156 in that situation maintains the continued operation of the pump motor 50 by means of a signal on motor control output 158 and simultaneously activates an alarm and shuts off the HVAC system by means of a signal on HVAC and alarm output 160.

Turning to FIG. 19, the capacitance sensor system 240 is similar to capacitance sensor system 140 except that the control module 254 comprises a microcontroller 256 and feedback resistors 268, 270, and 272. A low (empty) water control module input 242, an intermediate (run) water control module input 244, and a high (overflow) water control module input 246 are connected to separate inputs of the microcontroller 256. The microcontroller 256 has a feedback output 280 that is connected to input 242 through feedback resistor 268, to input 244 through feedback resistor 270, and to input 246 through feedback resistor 272. The microcontroller 256 determines the capacitance at its inputs 242, 244, and 246 by determining how long is required for the output 280 to charge each input 242, 244, or 246 to a predetermined threshold value. The time required to charge each of the inputs to the predetermined threshold value depends on the value of the capacitance connected to that particular input. If, for example, the empty capacitance sensor 122 is not in contact with condensate water in the reservoir 12, the resulting low capacitance value at input 242 will result in a relatively rapid charge time for the input 242 to reach its threshold value. Once the condensate water contacts the empty capacitance sensor 122, a substantially longer period of time will be required for the input 242 to reach its threshold value. Based on that time difference, the microcontroller 256 can determine whether the water is in contact with the empty capacitance sensor 122 or not.

Figure 20:
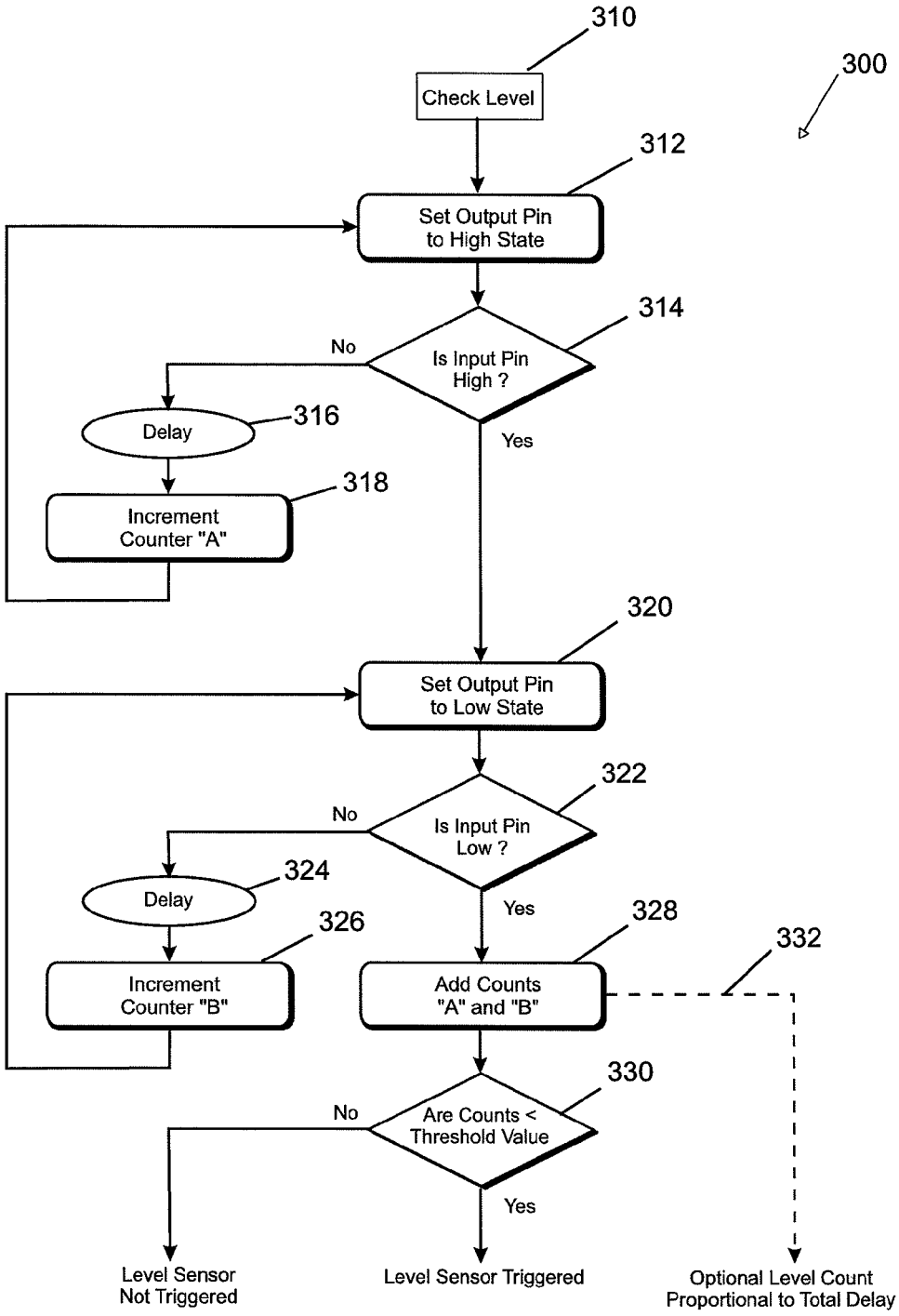
FIG. 20 is a flowchart illustrating the operation of the floatless condensate pump control module utilizing the capacitance sensor circuitry of FIG. 19 in accordance with the present invention.

FIG. 20 illustrates a sensor monitoring process 300 of the microcontroller 256 in FIG. 19 as microcontroller 256 continuously monitors the inputs 242, 244, and 246 from the capacitance sensors 122, 124, and 126 respectively. The method 300 begins at step 310 and proceeds to step 312, where the feedback output 280 of the microcontroller 256 is set to a high state. From step 312, the process proceeds to step 314, where the microcontroller 256 checks to determine if the input, such as input 242, has reached a predetermined high value threshold. If the input has not reached the predetermined high value threshold, the process follows the "no" branch to step 316, where a delay is imposed. Once the delay time has expired at step 316, the process proceeds to step 318, where a counter A is incremented. From step 318, the process loops back to step 312, where the output 280 is again set to a high state. From step 312, the process proceeds again to step 314, where the process checks to determine if the input, such as input 242, has reached the predetermined high value threshold. If the input has reached the predetermined high value threshold, the process follows the "yes" branch to step 320.

At step 320, the output 280 of the microcontroller 256 is set to a low state. From step 320, the process proceeds to step 322, where the microcontroller 256 checks to determine if the input, such as input 242, has reached a predetermined low value threshold. If the input has not reached the predetermined low value threshold, the process follows the "no" branch to step 324, where a delay is imposed. Once the delay time has expired at step 324, the process proceeds to step 326, where a counter B is incremented. From step 326, the process loops back to step 320, where the output 280 is again set to a low state. From step 320, the process proceeds again to step 322, where the process checks to determine if the input, such as input 242, has reached the predetermined low value threshold. If the input has reached the predetermined low value threshold, the process follows the "yes" branch to step 328.

At step 328, the process of 300 adds that counts in counters A and B. From step 328, the process proceeds to step 330, where the combined counts are compared to a predetermined threshold value. If the count is less than the threshold value, the process follows the "no" branch indicating that the capacitance value of the capacitance sensor is low, and the condensate water is not in contact with the capacitance sensor. If the count is greater than the threshold value, the process follows the "yes" branch indicating that the capacitance value of the capacitance sensor is high, and the condensate water is in contact with the capacitance sensor.

In the circumstance where a single capacitance sensor is employed instead of three separate capacitor sensors, the count at step 328, which is proportional to the level of the condensate water in the reservoir 12, could be used to control the motor, the alarm, and/or the HVAC system. Particularly, the method 300 follows the optional branch 332 to control the motor, the alarm, and/or the HVAC system.

The microcontrollers 98, 156, and 256 also allow other approaches to controlling the pump motor 50 where a single capacitance sensor is used. In one control embodiment, the microcontroller 256, for example, starts the pump motor 50 when the water first touches the single capacitance sensor, such as run capacitance sensor 122 located at the intermediate water level. A near overflow water level is then predicted based on the water remaining in contact with the single capacitance sensor, such as run capacitance sensor 122, for a predetermined period of time. The low water level (pump motor 50 stopped) is determined by the microcontroller 256 after a predetermined time after the water level drops below the single capacitance sensor. Alternatively the low water level could be calculated based on the dwell time that the water is in contact with the single capacitance sensor. In addition, adding an additional empty capacitance sensor, such as empty capacitance sensor 122, could be used to stop the pump motor 50 in a two capacitance sensor embodiment.

In another embodiment of the single capacitance sensor, relative or absolute capacitance of the single capacitance sensor is used to determine water levels in the reservoir 12. With the single, elongated capacitance sensor positioned in the reservoir 12 with its length vertically oriented. The capacitance of the single, vertically oriented capacitance sensor changes linearly with rising and falling water and that change in capacitance can be used by the microcontroller 256 to determine the water level in the reservoir 12. In addition, a specially shaped single, vertically oriented capacitance sensor having two or more horizontal step sections can cause abrupt changes in capacitance when each section is progressively contacted by the rising or falling water.

Figure 21:
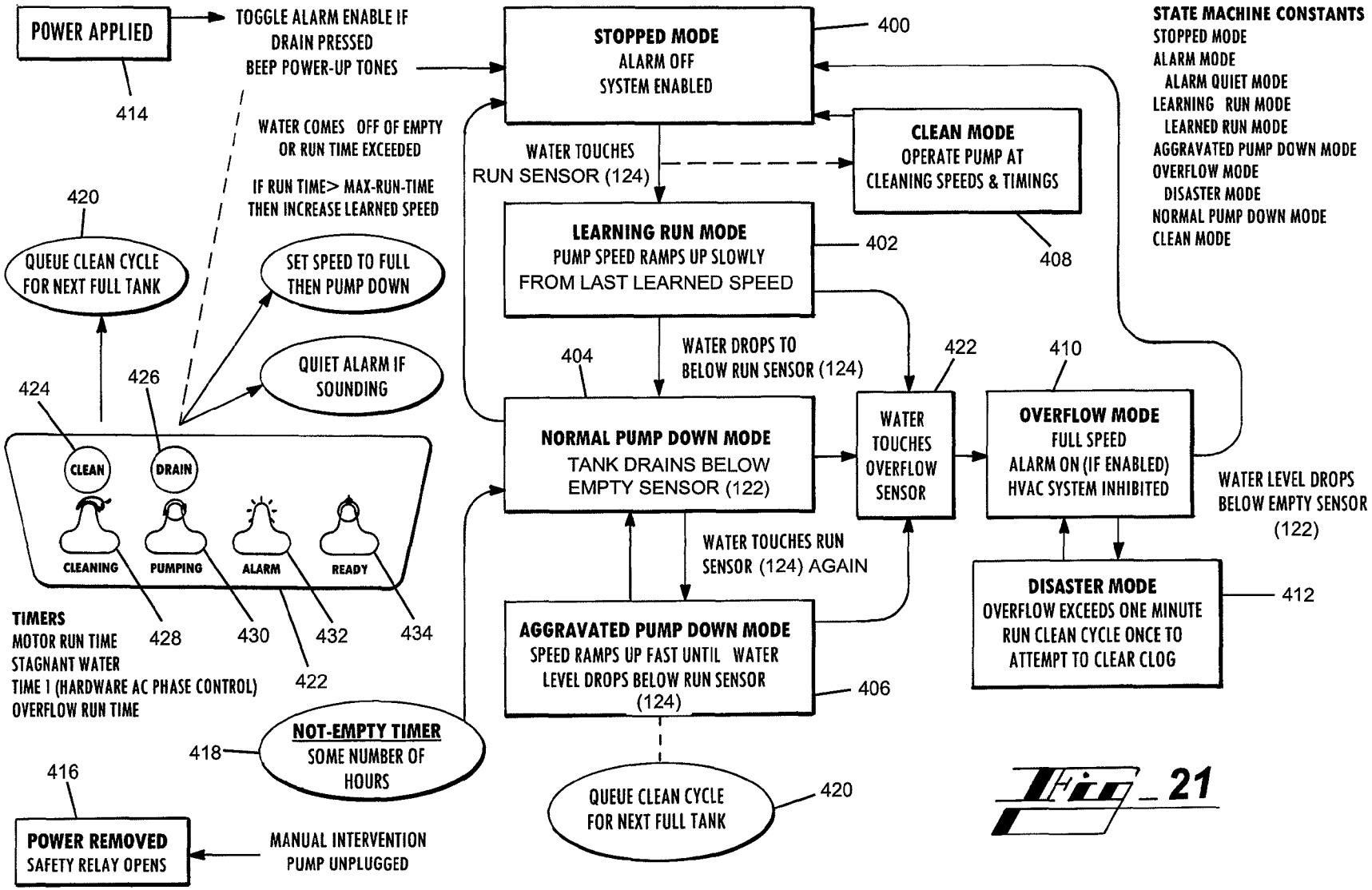
FIG. 21 is a state diagram illustrating the operation of the floatless condensate pump control module in accordance with the present invention.

In accordance with another aspect of the present invention, the microcontrollers 98, 156, or 256 can implement additional functionality to the condensate pump 10. Particularly, FIG. 21 shows a state diagram for the operation of the condensate pump 10 by the microcontroller 256, for example. In accordance with the operation of the condensate pump 10 under control of the microcontroller 256, the microcontroller 256 implements a run mode in which the speed of the pump motor 50 is gradually increased until it reaches a speed just necessary to lift the water from the elevation in the reservoir 12 through the drain line to the elevation of the outlet of the drain line. In that fashion, the pump motor 50 runs only as fast as necessary thereby minimizing pump noise and extending the life of the pump motor 50 and the impeller pump 62. In addition, when a clogged drain line occurs and an alarm condition exists because of a near overflow water level in the reservoir 12, the microcontroller 256 implements a disaster mode in which the pump motor 50 runs at high speed and in a pulse mode in order to dislodge the clog in the drain line. In addition, the microcontroller 256 can periodically implement a cleaning mode in which the pump motor 50 runs at high speed and in a pulse mode in order to agitate the water in the reservoir 12 to dislodge any scale from the reservoir 12 and to clear any clog, scale, or slime of the from the drain line. Further, the microcontroller 256 implements a stagnant water mode in which the microcontroller 256 starts the pump motor 50 after a predetermined time to ensure that any water in the reservoir below the intermediate (run) water level is pumped from the reservoir 12 to inhibit the growth of algae and the formation of slime within the reservoir 12.

Turning to FIG. 21, the relationship among the operating states of the microcontroller 256 are shown. When AC power is applied (414) to the condensate pump 10, the microcontroller 256 enters the stopped mode 400. In the stopped mode 400, alarm 508 (FIG. 22) is off and alarm indicator 432 is deactivated. In addition, in the stopped mode 400, the HVAC system is enabled after a suitable short cycle time delay. Optionally, the microcontroller 256 may activate an audible power up signal such as a beep tone.

From the stopped mode 400, the microcontroller 256 enters the learning run mode 402 if the condensate water touches the run capacitance sensor 124 (FIG. 19). In the learning run mode 402, the microcontroller 256 starts the pump motor 50 at a first low speed. In order to assure that the pump motor 50 starts in the circumstance where the bearings of the pump motor 50 might bind, such as after being idle for an extended period, the microcontroller 256 applies full power to the pump motor 50 for a short time, perhaps as little as two cycles of AC current. The speed of the pump motor 50 ramps up slowly from the last learned pump speed until the water drops below the run capacitance sensor 124. At that point, the microcontroller 256 records the learned speed for the next operation of the pump. The learning run mode 402 can be implemented by the microcontroller 256 in several ways. In one embodiment, the microcontroller 256 starts the pump motor 50 at a slow speed when the water first touches the run capacitance sensor 124. Once the pump motor 50 has started, the speed of the pump motor 50 begins increasing. Even after the pump motor 50 starts in response to the water touching the run capacitance sensor 124, the water may continue rising because the impeller pump 62, running at the initial slow speed of the pump motor 50, has not begun to pump sufficient water out of the reservoir 12 to offset the flow of water into the reservoir 12 from the HVAC system. In addition, when water touches the run capacitance sensor 124, capillary, action and vibration typically cause the water to a whip along the whole (horizontal) length of the run capacitance sensor 124. The residual presence of water on the run capacitance sensor 124 and the initial rising of the water for the pump motor 50 first starts creates a hysteresis effect so that the pump speed continues ramping up until even the residual water is no longer in contact with the run capacitance sensor 124. Once the residual water is no longer in contact with the run capacitance sensor 124, the ramping up of the speed of the pump motor 50 is discontinued, and the pump motor speed is temporarily recorded as the learned speed value. The impeller pump 62 then continues to pump the water out of the reservoir 12 at the learned speed until the reservoir 12 is emptied. In the case of the first run, when the drain line is empty, the impeller pump 62 may run for a while and not empty the reservoir 12. In that case sufficient motor speed to overcome the head height of the outlet of the drain line was not achieved, but enough water was evacuated from the reservoir (and is increasing the head height as it fills the drain line overhead). When initial pumping condition occurs, the pump motor 50 is shut off in anticipation of more water. The next time the water level reaches the run capacitance sensor 124, the pump motor 50 is restarted at the learned value and increases its speed to overcome the head height required to lower the water in the reservoir 12 below the run capacitance sensor 124. Because the pump includes a check valve in the water outlet 72 this "speed ratcheting" continues until optimum pump speed is achieved.

[Ramp based on time dwell.] In another embodiment, the pump motor 50 learns the minimum speed for lifting the water in the reservoir 12 to the outlet of the drain line by timing the a dwell time that the water stays at or above the intermediate water level while the pump motor 50 is running at the first low speed. If the dwell time exceeds a first predetermined threshold, the speed of the pump motor 50 is increased until the dwell time is reduced to a second predetermined threshold thereby keeping the speed of the pump motor at the lowest speed required to pump the water out of the reservoir 12 through the drain line to the elevation of the outlet of the drain line.

In order to assure optimum operating speed for the pump motor 50, subsequent pump motor starts are at the "learned" speed value minus a small factor. Because the pump motor 50 restarts at a speed that is slightly lower than the last run ("learned") speed, but higher than the minimum speed, time and energy wasted running the pump at less than the correct speed are minimized. Because the pump motor 50 starts at a speed that is just slightly lower than optimum, each successive pump cycle results in a continuous tuning of the pump speed.

From the learning run mode 402, the microcontroller 256 enters the normal pump down mode 404. In the normal pump down mode 404, the pump motor 50 continues running at the learned run speed until the condensate water falls below the empty capacitance sensor 122 (FIG. 19). At that point, the microcontroller 256 returns to the stopped mode 400. If the condensate water does not fall below the empty capacitance sensor 122 within a predetermined time period or if the condensate water rises to touch the run capacitance sensor 124 again, the microcontroller 256 enters the aggravated pump down mode 406. In the aggravated pump down mode 406, the pump motor 50 speeds up quickly in order to catch up with the rising condensate water. If the condensate water once again falls below the run capacitance sensor 124, the microcontroller 256 returns to the normal pump down mode 404. In the aggravated pump down mode 406, the microcontroller 256 sets the queue clean cycle flag 420 for next full tank (water touches the run capacitance sensor 124) so that at the next full tank, the microcontroller 256 will proceed to the clean mode 408.

If, while the microcontroller 256 is in the aggravated pump down mode 406, is in the learning run mode 402, or is in the normal pump down mode 404, the condensate water touches the overflow capacitance sensor 126 (FIG. 19), the microcontroller 256 enters mode 422 and then proceeds to the overflow mode 410. In the overflow mode 410, the microcontroller 256 causes the pump motor 50 runs at full speed, activates the alarm, and disables the HVAC system. If, while in the overflow mode 410, the pumping time exceeds a predetermined threshold, the microcontroller 256 enters the disaster mode 412. In the disaster mode 412, the microcontroller 256 runs the clean cycle once, during which the motor 50 runs with rapidly varying speed to create pulsating water in the drain line, in an attempt to unclog the drain line. If, while in the overflow mode, the water level drops below the empty capacitance sensor 122, the microcontroller 256 returns to the stopped mode 400.

If the queue clean cycle flag 420 was previously set for next full tank, the microcontroller 256 enters the clean mode 408 in which the pump cycles through a series of variable speeds to create pulses through the drain line to clear build up of slime and to agitate the condensate water in the reservoir 12 to loosen scaling on the walls of the reservoir 12.

If condensate water is touching the empty capacitance sensor 122 and that condition has existed for a number of hours without the microcontroller 256 leaving the stopped mode 400, the microcontroller 256 enters the normal pump down mode 404 in order to empty the reservoir 12 of any stagnant water that may be present.

The control panel 422 offers the operator the option of setting the clean cycle flag 420 manually for the next full tank by means of queue clean cycle switch 424. The queue clean cycle switch 424 sets the queue clean cycle flag 420 so that at the next full tank, the microcontroller 256 will enter the clean mode 408. The control panel 422 further has a drain switch 426 that allows the operator to cause the microcontroller 256 to enter the pump down mode 404 and thereby drain the reservoir 12. Activating the drain switch 426 may optionally quiet the alarm.

The control panel 422 also has a cleaning indicator 428, a pumping indicator 430, alarm indicator 432, and a ready indicator 434. The cleaning indicator 428 illuminates to show that the microcontroller 256 is in the clean mode 408. The pumping indicator 430 illuminates to show that the microcontroller 256 is in the learning run mode 402, the normal pump down mode 404, the aggravated pump down mode 406, the overflow mode 410, the disaster mode 412, or the clean mode 408. The ready indicator 434 illuminates to show that the power has been applied (414), and the microcontroller 256 has reached the stopped mode 400.

When power is removed (416), the safety relay switch 106 is open, and the HVAC system is thereby disabled.

Figure 22:
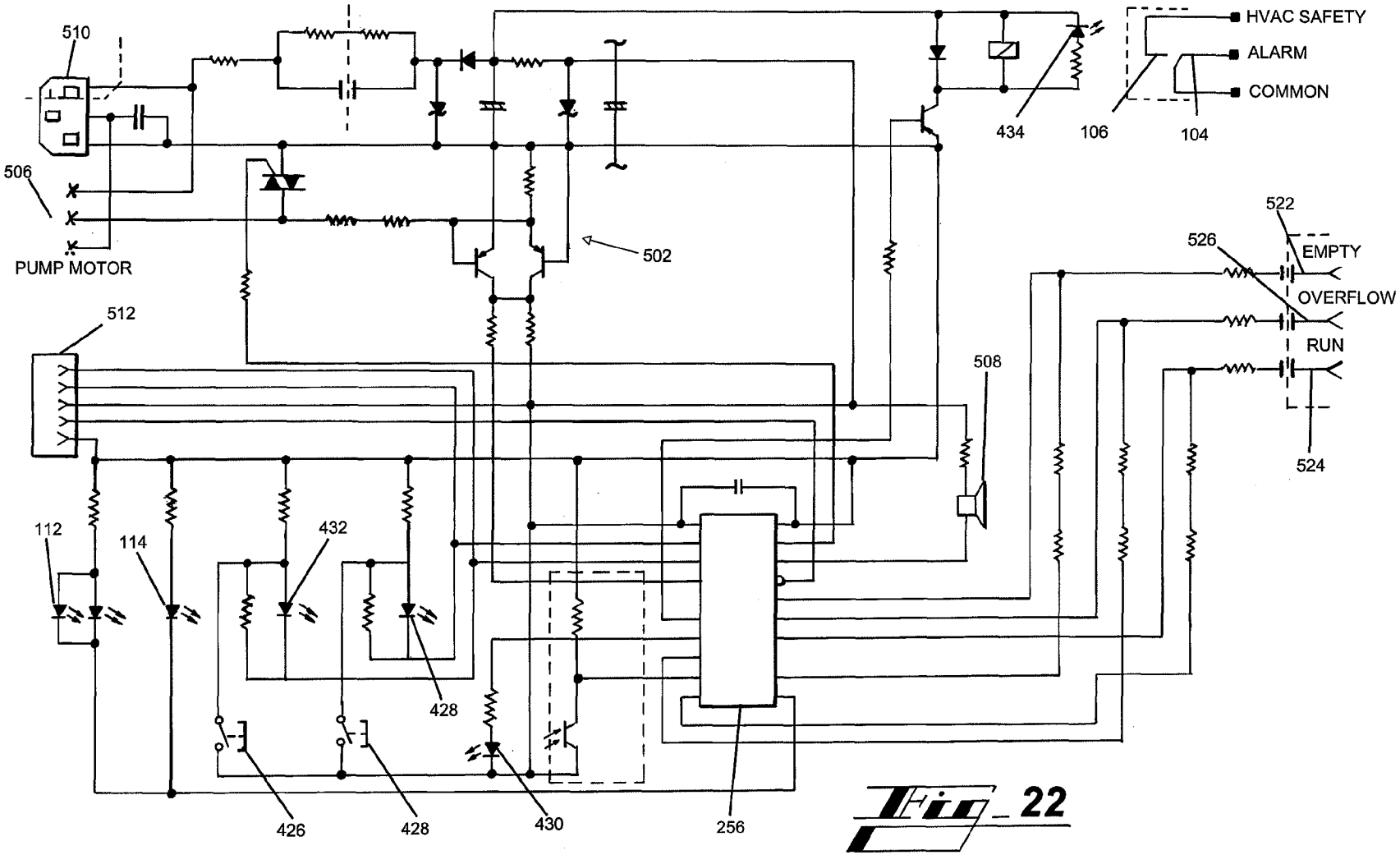
FIG. 22 is a schematic diagram of the floatless condensate pump control module for controlling the operation of the floatless condensate pump in accordance with the present invention.

FIG. 22 is a schematic diagram 500 of the control module 54. The control module 54 includes an AC power connector 510, a motor on/off and speed controller 502, pump motor connections 506, the alarm switch 104, the HVAC disable safety switch 106, the infrared data LED 114, the visible data LED 112, the clean indicator 428, the pumping indicator 430, the alarm indicator 432, the ready indicator 434, an alarm 508, the queue clean cycle switch 424, the drain switch 426, test points connector 512, empty input 522 (from empty capacitance sensor 122), run input 524 (from run capacitance sensor 124), overflow input 526 (from overflow capacitance sensor 126), and the microcontroller 256. When the AC power connector 510 is disconnected from a source of AC current, the HVAC safety switch 106 is normally open and the alarm switch 104 is normally closed so that the HVAC system is initially disabled and the alarm is initially enabled. When the AC power connector 510 is connected to a source of AC current, the alarm switch 104 is opened and the HVAC safety switch 106 is closed so that the alarm is silenced and the HVAC system is enabled to run after a suitable short cycle time delay. The microcontroller 256 controls the starting, stopping, and the speed of the pump motor 50 by means of the speed controller 502. The microcontroller 256 receives input signals on empty input 522 (from empty capacitance sensor 122), run input 524 (from run capacitance sensor 124), overflow input 526 (from overflow capacitance sensor 126) to determine the water level in the reservoir 12. The microcontroller 256 also receives control signals from drain switch 426 and queue clean cycle switch 424 to allow manual intervention to drain the reservoir 12 and to queue a clean cycle when the tank is next full. In response to the input signals, the microcontroller 256 controls the speed of the motor 50 by means of the speed controller 502, the HVAC safety switch 106, the alarm switch 104, the clean indicator 428, the pump indicator 430, the alarm indicator 432, the ready indicator 434, the infrared data LED 114, and the visible data LED 112 all in accordance with the state diagram FIG. 21.

While this invention has been described with reference to preferred embodiments thereof, it is to be understood that variations and modifications can be affected within the spirit and scope of the invention as described herein and as described in the appended claims.

I claim:

1. A pump control module for an HVAC system having a reservoir for collecting condensate water, the condensate water being pumped out of the reservoir via a pump impeller driven by a variable speed motor to a destination through an outlet of a drain line located at an elevation above the pump, wherein the control module comprises:

a) a floatless water level sensor for detecting the level of water in the reservoir;

b) a control switch for starting and stopping of the motor, and for controlling the speed of the motor; and c) a microcontroller for controlling the operation of the control switch, in response to the detected water level, the microcontroller implementing is configured to implement the steps of:

i. monitoring of the water level sensor and detecting when the water in the reservoir has reached an intermediate level;

ii. in response to the water reaching the intermediate level, starting the motor at a first low speed;

iii. increasing the speed of the motor until the speed of the pump motor is sufficient to pump the water out of the reservoir through the drain line to the elevation of the outlet of the drain line;

iv. monitoring the water level sensor while the speed of the motor is increasing; and v. setting the speed of the motor at the lowest speed reached when the water subsequently falls below the intermediate level.

2. The pump control module of claim 1, wherein the microcontroller further is configured to implement the steps of:

a) timing a dwell time that the water stays at or above the intermediate level while the motor is running at the first low speed; and b) in response to the dwell time exceeding a first predetermined threshold increasing the speed of the motor until the dwell time is reduced to a second predetermined threshold thereby keeping the speed of the motor at the lowest speed required to pump the water out of the reservoir through the drain line to the elevation of the outlet of the drain line.

3. The floatless condensate pump control module of claim 1, wherein the starting step includes applying full power to the motor for a short period of time to ensure that the motor starts prior to establishing the first low speed for the motor.

4. The floatless condensate pump control module of claim 1, wherein the water level sensor includes an empty capacitance sensor located at a low water level in the reservoir, a run capacitance sensor located at the intermediate water level in the reservoir, and an overflow capacitance sensor located at a near overflow water level in the reservoir, each of the capacitance sensors being connected to the microcontroller, wherein the microcontroller determines whether the water in the reservoir is at a low water level, at an intermediate water level, or at a near overflow water level based on changes in capacitance of each capacitance sensor when each capacitor sensor is in contact with the water in the reservoir.

5. The floatless condensate pump control module of claim 1, wherein the water level sensor includes an empty capacitance sensor located at a low water level in the reservoir and a run capacitance sensor located at an intermediate water level in the reservoir, each of the capacitance sensors being connected to the microcontroller, wherein the microcontroller determines whether the water in the reservoir is at a low water level based on a change in capacitance of the empty capacitance sensor when the empty capacitor sensor is in contact with the water in the reservoir, wherein the microcontroller determines whether the water in the reservoir is at an intermediate water level based on a change in capacitance of the run capacitance sensor when the run capacitor sensor is in contact with the water in the reservoir, and wherein the microcontroller determines whether the water in the reservoir is at a near overflow water level based on the time that the water in the reservoir is in contact with the run capacitance sensor while the motor is running.

6. The pump control module of claim 1, wherein the water level sensor includes an elongated capacitance sensor located in the reservoir with its length vertically oriented in the reservoir, the capacitance sensor being connected to the microcontroller, wherein the microcontroller determines whether the water in the reservoir is at a low water level, an intermediate water level, or a near overflow water level based on changes in capacitance of the capacitance sensor as the water in the reservoir rises and falls along the length of the capacitance sensor.

7. The pump control module of claim 1, wherein the water level sensor is an ultrasonic transmitter and receiver.

8. The pump control module of claim 1, wherein the floatless condensate pump control module further includes a status indicator light controlled by the microcontroller to indicate visually the operating status of the condensate pump.

9. The pump control module of claim 1, wherein the floatless condensate pump control module further includes an infrared emitter and an infrared receiver connected to the microcontroller for transmitting and receiving data to and from the microcontroller.

10. The floatless condensate pump control module of claim 1, wherein the floatless condensate pump control module further includes an RF transceiver connected to the microcontroller for transmitting and receiving data to and from the microcontroller.

11. The pump control module of claim 1, wherein the floatless condensate pump control module further includes an alarm switch controlled by the microcontroller to sound an alarm when the condensate water in the reservoir reaches a near overflow condition.

12. The pump control module of claim 1, wherein the floatless condensate pump control module further includes a safety switch controlled by the microcontroller to shut down the HVAC system when the condensate water in the reservoir reaches a near overflow condition.

13. A pump control module for an HVAC system having a reservoir for collecting condensate water, the condensate water being pumped out of the reservoir via a pump impeller driven by a variable speed motor, wherein the control module comprises:

a) a floatless water level sensor for detecting the level of water in the reservoir;

b) a control switch for starting and stopping of the motor, and for controlling the speed of the motor;

c) an HVAC control switch to enable and disable the HVAC system; and d) a microcontroller for controlling the operation of the control switch, in response to the detected water level, the microcontroller is configured to implement the steps of:

i. detecting when the water in the reservoir has reached a near overflow water level;

ii. in response to the water reaching the near overflow water level, increasing the speed of the motor to its maximum speed;

iii. timing a first dwell time that the water stays at or above the near overflow water level;

iv. in response to the first dwell time exceeding a first predetermined threshold, rapidly changing the speed of the motor to create pulses of water in the drain line;

v. timing a second dwell time that the water stays at or above the near overflow water level after the motor begins rapidly changing speeds; and vi. in response to the second dwell time exceeding a second predetermined threshold, shutting off the HVAC system by means of the HVAC control switch.

14. The pump control module of claim 13, wherein the water level sensor includes an empty capacitance sensor located at a low water level in the reservoir, a run capacitance sensor located at an intermediate water level in the reservoir, and an overflow capacitance sensor located at the near overflow water level in the reservoir, each of the capacitance sensors being connected to the microcontroller, wherein the microcontroller determines whether the water in the reservoir is at the low water level, at the intermediate water level, or at the near overflow water level based on changes in capacitance of each capacitance sensor when each capacitor sensor is in contact with the water in the reservoir.

15. The pump control module of claim 13, wherein the water level sensor includes an empty capacitance sensor located at a low water level in the reservoir and a run capacitance sensor located at an intermediate water level in the reservoir, each of the capacitance sensors being connected to the microcontroller, wherein the microcontroller determines whether the water in the reservoir is at the low water level based on a change in capacitance of the empty capacitance sensor when the empty capacitor sensor is in contact with the water in the reservoir, wherein the microcontroller determines whether the water in the reservoir is at the intermediate water level based on a change in capacitance of the run capacitance sensor when the run capacitor sensor is in contact with the water in the reservoir, and wherein the microcontroller determines whether the water in the reservoir is at the near overflow water level based on the time that the water in the reservoir is in contact with the run capacitance sensor while the motor is running.

16. The pump control module of claim 13, wherein the water level sensor includes an elongated capacitance sensor located in the reservoir with its length vertically oriented in the reservoir, the capacitance sensor being connected to the microcontroller, wherein the microcontroller determines whether the water in the reservoir is at a low water level, an intermediate water level, or the near overflow water level based on changes in capacitance of the capacitance sensor as the water in the reservoir rises and falls along the length of the capacitance sensor.

17. The pump control module of claim 13, wherein the water level sensor is an ultrasonic transmitter and receiver.

18. The pump control module of claim 13, wherein the floatless condensate pump control module further includes a status indicator light controlled by the microcontroller to indicate visually the operating status of the condensate pump.

19. The pump control module of claim 13, wherein the floatless condensate pump control module further includes an infrared emitter and an infrared receiver connected to the microcontroller for transmitting and receiving data to and from the microcontroller.

20. The floatless condensate pump control module of claim 13, wherein the floatless condensate pump control module further includes an RF transceiver connected to the microcontroller for transmitting and receiving data to and from the microcontroller.

21. The pump control module of claim 13, wherein the floatless condensate pump control module further includes an alarm switch controlled by the microcontroller to sound an alarm when the condensate water in the reservoir reaches a near overflow condition.

22. The pump control module of claim 13, wherein the floatless condensate pump control module further includes a safety switch controlled by the microcontroller to shut down the HVAC system when the condensate water in the reservoir reaches a near overflow condition.

23. A pump control module for an HVAC system having a reservoir for collecting condensate water, the condensate water being pumped out of the reservoir via a pump impeller driven by a variable speed motor, wherein the pump control module comprises:

a) a floatless water level sensor for detecting the level of water in the reservoir;

b) a control switch for starting and stopping of the motor, and for controlling the speed of the motor; and c) a microcontroller for controlling the operation of the control switch, in response to the detected water level, the microcontroller is configured to implement the steps of:

i. timing a cleaning dwell time;

ii. determining that the cleaning dwell time has exceed a predetermined threshold and that the water in the reservoir has reached an intermediate water level; and iii. in response to the cleaning dwell time exceeding the predetermined threshold and in response to the water being at or above the intermediate water level, starting the motor and rapidly changing the speed of the motor to create pulses of water in the drain line and to agitate the water in the reservoir.

24. The pump control module of claim 23, wherein the starting step includes applying full power to the motor for a short period of time to ensure that the motor starts prior to rapidly changing the speed of the motor.

25. The pump control module of claim 23, wherein the water level sensor includes an empty capacitance sensor located at a low water level in the reservoir, a run capacitance sensor located at the intermediate water level in the reservoir, and an overflow capacitance sensor located at a near overflow water level in the reservoir, each of the capacitance sensors being connected to the microcontroller, wherein the microcontroller determines whether the water in the reservoir is at the low water level, at the intermediate water level, or at the near overflow water level based on changes in capacitance of each capacitance sensor when each capacitor sensor is in contact with the water in the reservoir.

26. The pump control module of claim 23, wherein the water level sensor includes an empty capacitance sensor located at a low water level in the reservoir and a run capacitance sensor located at the intermediate water level in the reservoir, each of the capacitance sensors being connected to the microcontroller, wherein the microcontroller determines whether the water in the reservoir is at the low water level based on a change in capacitance of the empty capacitance sensor when the empty capacitor sensor is in contact with the water in the reservoir, wherein the microcontroller determines whether the water in the reservoir is at the intermediate water level based on a change in capacitance of the run capacitance sensor when the run capacitor sensor is in contact with the water in the reservoir, and wherein the microcontroller determines whether the water in the reservoir is at the near overflow water level based on the time that the water in the reservoir is in contact with the run capacitance sensor while the motor is running.

27. The pump control module of claim 23, wherein the water level sensor includes an elongated capacitance sensor located in the reservoir with its length vertically oriented in the reservoir, the capacitance sensor being connected to the microcontroller, wherein the microcontroller determines whether the water in the reservoir is at a low water level, the intermediate water level, or a near overflow water level based on changes in capacitance of the capacitance sensor as the water in the reservoir rises and falls along the length of the capacitance sensor.

28. The pump control module of claim 23, wherein the water level sensor is an ultrasonic transmitter and receiver.

29. The pump control module of claim 23, wherein the floatless condensate pump control module further includes a status indicator light controlled by the microcontroller to indicate visually the operating status of the condensate pump.

30. The pump control module of claim 23, wherein the floatless condensate pump control module further includes an infrared emitter and an infrared receiver connected to the microcontroller for transmitting and receiving data to and from the microcontroller.

31. The floatless condensate pump control module of claim 23, wherein the floatless condensate pump control module further includes an RF transceiver connected to the microcontroller for transmitting and receiving data to and from the microcontroller.

32. The pump control module of claim 23, wherein the floatless condensate pump control module further includes an alarm switch controlled by the microcontroller to sound an alarm when the condensate water in the reservoir reaches a near overflow condition.

33. The pump control module of claim 23, wherein the floatless condensate pump control module further includes a safety switch controlled by the microcontroller to shut down the HVAC system when the condensate water in the reservoir reaches a near overflow condition.

34. A pump control module for an HVAC system having a reservoir for collecting condensate water, the condensate water being pumped out of the reservoir via a pump impeller driven by a variable speed motor to a destination through an outlet of a drain line located at an elevation above the pump, wherein the control module comprises:

a) a floatless water level sensor for detecting the level of water in the reservoir;

b) a control switch for starting and stopping of the motor, and for controlling the speed of the motor; and c) a microcontroller for controlling the operation of the control switch, in response to the detected water level, the microcontroller is configured to implement the steps of:

i. monitoring of the water level sensor and detecting when the water in the reservoir has reached an intermediate level;

ii. in response to the water reaching the intermediate level, starting the motor at a first low speed; and iii. increasing the speed of the motor until the speed of the motor is sufficient to pump the water out of the reservoir through the drain line to the elevation of the outlet of the drain line;

iv. timing a dwell time that the water stays at or above the intermediate level while the motor is running at the first low speed; and v. in response to the dwell time exceeding a first predetermined threshold increasing the speed of the motor until the dwell time is reduced to a second predetermined threshold thereby keeping the speed of the motor at the lowest speed required to pump the water out of the reservoir through the drain line to the elevation of the outlet of the drain line.

35. The pump control module of claim 34, wherein the microcontroller further is configured to implement the steps of:

a) monitoring the water level sensor while the speed of the motor is increasing; and b) setting the speed of the motor at the lowest speed reached when the water subsequently falls below the intermediate level.

36. The pump control module of claim 34, wherein the starting step includes applying full power to the motor for a short period of time to ensure that the motor starts prior to establishing the first low speed for the motor.

37. The pump control module of claim 34, wherein the water level sensor includes an empty capacitance sensor located at a low water level in the reservoir, a run capacitance sensor located at the intermediate water level in the reservoir, and an overflow capacitance sensor located at a near overflow water level in the reservoir, each of the capacitance sensors being connected to the microcontroller, wherein the microcontroller determines whether the water in the reservoir is at a low water level, at an intermediate water level, or at a near overflow water level based on changes in capacitance of each capacitance sensor when each capacitor sensor is in contact with the water in the reservoir.

38. The pump control module of claim 34, wherein the water level sensor includes an empty capacitance sensor located at a low water level in the reservoir and a run capacitance sensor located at an intermediate water level in the reservoir, each of the capacitance sensors being connected to the microcontroller, wherein the microcontroller determines whether the water in the reservoir is at a low water level based on a change in capacitance of the empty capacitance sensor when the empty capacitor sensor is in contact with the water in the reservoir, wherein the microcontroller determines whether the water in the reservoir is at an intermediate water level based on a change in capacitance of the run capacitance sensor when the run capacitor sensor is in contact with the water in the reservoir, and wherein the microcontroller determines whether the water in the reservoir is at a near overflow water level based on the time that the water in the reservoir is in contact with the run capacitance sensor while the motor is running.

39. The pump control module of claim 34, wherein the water level sensor includes an elongated capacitance sensor located in the reservoir with its length vertically oriented in the reservoir, the capacitance sensor being connected to the microcontroller, wherein the microcontroller determines whether the water in the reservoir is at a low water level, an intermediate water level, or a near overflow water level based on changes in capacitance of the capacitance sensor as the water in the reservoir rises and falls along the length of the capacitance sensor.

40. The pump control module of claim 34, wherein the water level sensor is an ultrasonic transmitter and receiver.

41. The pump control module of claim 34, wherein the floatless condensate pump control module further includes a status indicator light controlled by the microcontroller to indicate visually the operating status of the condensate pump.

42. The floatless condensate pump control module of claim 34, wherein the floatless condensate pump control module further includes an infrared emitter and an infrared receiver connected to the microcontroller for transmitting and receiving data to and from the microcontroller.

43. The pump control module of claim 34, wherein the floatless condensate pump control module further includes an alarm switch controlled by the microcontroller to sound an alarm when the condensate water in the reservoir reaches a near overflow condition.

44. The pump control module of claim 34, wherein the floatless condensate pump control module further includes a safety switch controlled by the microcontroller to shut down the HVAC system when the condensate water in the reservoir reaches a near overflow condition.

45. A pump control module for an HVAC system having a reservoir for collecting condensate water, the condensate water being pumped out of the reservoir via a pump impeller driven by a variable speed motor to a destination through an outlet of a drain line located at an elevation above the pump, wherein the control module comprises:

a) a floatless water level sensor for detecting the level of water in the reservoir;

b) a control switch for starting and stopping of the motor, and for controlling the speed of the motor; and c) a microcontroller for controlling the operation of the control switch, in response to the detected water level, the microcontroller is configured to implement the steps of:

i. monitoring of the water level sensor and detecting when the water in the reservoir has reached an intermediate level;

ii. in response to the water reaching the intermediate level, starting the motor at a first low speed; and iii. increasing the speed of the motor until the speed of the motor is sufficient to pump the water out of the reservoir through the drain line to the elevation of the outlet of the drain line, and wherein the water level sensor includes an empty capacitance sensor located at a low water level in the reservoir and a run capacitance sensor located at an intermediate water level in the reservoir, each of the capacitance sensors being connected to the microcontroller, wherein the microcontroller determines whether the water in the reservoir is at a low water level based on a change in capacitance of the empty capacitance sensor when the empty capacitor sensor is in contact with the water in the reservoir, wherein the microcontroller determines whether the water in the reservoir is at an intermediate water level based on a change in capacitance of the run capacitance sensor when the run capacitor sensor is in contact with the water in the reservoir, and wherein the microcontroller determines whether the water in the reservoir is at a near overflow water level based on the time that the water in the reservoir is in contact with the run capacitance sensor while the motor is running.

46. The pump control module of claim 45, wherein the microcontroller further is configured to implement the steps of:

a) monitoring the water level sensor while the speed of the motor is increasing; and b) setting the speed of the motor at the lowest speed reached when the water subsequently falls below the intermediate level.

47. The pump control module of claim 45, wherein the microcontroller further is configured to implement the steps of:

a) timing a dwell time that the water stays at or above the intermediate level while the motor is running at the first low speed; and b) in response to the dwell time exceeding a first predetermined threshold increasing the speed of the motor until the dwell time is reduced to a second predetermined threshold thereby keeping the speed of the motor at the lowest speed required to pump the water out of the reservoir through the drain line to the elevation of the outlet of the drain line.

48. The pump control module of claim 45, wherein the starting step includes applying full power to the motor for a short period of time to ensure that the motor starts prior to establishing the first low speed for the motor.

49. The pump control module of claim 45, wherein the water level sensor includes an empty capacitance sensor located at a low water level in the reservoir, a run capacitance sensor located at the intermediate water level in the reservoir, and an overflow capacitance sensor located at a near overflow water level in the reservoir, each of the capacitance sensors being connected to the microcontroller, wherein the microcontroller determines whether the water in the reservoir is at a low water level, at an intermediate water level, or at a near overflow water level based on changes in capacitance of each capacitance sensor when each capacitor sensor is in contact with the water in the reservoir.

50. The pump control module of claim 45, wherein the water level sensor includes an elongated capacitance sensor located in the reservoir with its length vertically oriented in the reservoir, the capacitance sensor being connected to the microcontroller, wherein the microcontroller determines whether the water in the reservoir is at a low water level, an intermediate water level, or a near overflow water level based on changes in capacitance of the capacitance sensor as the water in the reservoir rises and falls along the length of the capacitance sensor.

51. The pump control module of claim 45, wherein the water level sensor is an ultrasonic transmitter and receiver.

52. The pump control module of claim 45, wherein the floatless condensate pump control module further includes a status indicator light controlled by the microcontroller to indicate visually the operating status of the condensate pump.

53. The pump control module of claim 45, wherein the floatless condensate pump control module further includes an infrared emitter and an infrared receiver connected to the microcontroller for transmitting and receiving data to and from the microcontroller.

54. The pump control module of claim 45, wherein the floatless condensate pump control module further includes an alarm switch controlled by the microcontroller to sound an alarm when the condensate water in the reservoir reaches a near overflow condition.

55. The pump control module of claim 45, wherein the floatless condensate pump control module further includes a safety switch controlled by the microcontroller to shut down the HVAC system when the condensate water in the reservoir reaches a near overflow condition.

* * * * *